US005914224A

United States Patent [19]

Yamazaki et al.

[11] Patent Number: 5,914,224

[45] Date of Patent: Jun. 22, 1999

[54] SILVER HALIDE PHOTOGRAPHIC LIGHT-SENSITIVE MATERIAL

[75] Inventors: Katsumasa Yamazaki; Takesi Nakamura, both of Kanagawa-ken, Japan

[73] Assignee: Konica Corporation, Japan

[21] Appl. No.: 08/942,110

[22] Filed: Oct. 1, 1997

[30] Foreign Application Priority Data

Oct. 8, 1996 [JP] Japan ..... 8-267116

[51] Int. Cl.[6] ..... G03C 1/95; G03C 1/30

[52] U.S. Cl. ..... 430/523; 430/539; 430/950; 430/961

[58] Field of Search ..... 430/523, 539, 430/950, 961

[56] References Cited

U.S. PATENT DOCUMENTS

| | | | |
|---|---|---|---|
| 4,094,848 | 6/1978 | Naito | 430/950 |
| 5,085,981 | 2/1992 | Himmelmann et al. | 430/523 |
| 5,122,445 | 6/1992 | Ishigaki | 430/523 |
| 5,441,860 | 8/1995 | Fornasari | 430/523 |
| 5,756,200 | 5/1998 | Ebisch | 430/523 |

*Primary Examiner*—Richard L. Schilling
*Attorney, Agent, or Firm*—Jordan B. Bierman; Bierman, Muserlian and Lucas

[57] ABSTRACT

A silver halide photographic light-sensitive material is disclosed. It comprising at least one light-sensitive silver halide emulsion layer and at least one non-light-sensitive layer on a support and the non-light-sensitive layer contains porous fine particles of 400 mg per 1 $m^2$ or more and the material is hardened utilizing at least one of vinyl sulfone hardener, carboxyl-activating hardener or polymeric hardener.

8 Claims, No Drawings

SILVER HALIDE PHOTOGRAPHIC LIGHT-SENSITIVE MATERIAL

BACKGROUND OF THE INVENTION

The present invention relates to a silver halide photographic light-sensitive material and more specifically to a silver halide photographic light-sensitive material which has improved abrasion resistance during and after processing and excellent pressure resistance during processing, and results in excellent writing and stamping properties, and yields an image in repose.

The silver halide photographic light-sensitive material is manufactured by coating hydrophilic colloid layers comprising at least one silver halide emulsion layer on a support.

In recent years, in the case of the color paper, photographic prints having glossy appearance have generally attracted customers. However, the gloss enhanced by light reflection sometimes hinders observing the images on the print.

On the contrary, when prints are prepared for a customer who is not fond of gloss finish or when print images having depth are required, prints have been prepared employing so-called embossed RC paper of which surface is previously treated so as to have a matte surface, silk surface, etc.

However, the prints prepared by utilizing the color paper employing any of these embossed RC papers result in strong light reflection depending on an observing position and carry no image having sufficient depth.

Furthermore, for a long time, it has been required that the surface of the print can be written with various kinds of pens. However, there has been prepared no print meeting fully the requirement.

It has been impossible to write letters on the surface with a pencil. It has been possible to write letters on the surface with a fountain pen. However, since ink does not adhere perfectly onto the surface, written letters become unclear and are erased easily by rubbing with a fingertip.

Improvement in writing letters on the surface has been highly required especially for the color paper employed for preparing postcards. When employed as the postcard, it is required to meet various requirements such as that customers write letters or affix a stamp on the surface.

For writing letters, there are a variety of writing implements and there are employed a pencil, a fountain pen, a ball point pen, a Magic water ink pen, a Magic oil ink pen, a brush dipped with Chinese ink, and the like. Furthermore, there are various kinds of stamp inks. Therefore, for the writing, the compatibility with all the writing implements are required.

Japanese Patent Publication Open to Public Inspection Nos. 61-147248, 1-142630, 6-75331, 8-44010, etc. disclose methods for improving the surface gloss and enabling the writing on the surface, wherein a large amount of fine particles is put onto the surface or into the interior of a photographic light-sensitive material to obtain matting effect. The prints obtained by employing these methods have images having somewhat depth and somewhat writing properties. However, the compatibility with every kind of writing implements has not been sufficient.

Furthermore, such photographic light-sensitive materials are vulnerable to abrasion marks and pressure marks when the photographic composition layer is swelled by water or a processing solution. Namely, during photographic processing, abrasion marks are liable to be formed and when pressure is applied in a processing solution, pressure marks are liable to be formed. Especially, the photographic light-sensitive material comprising fine particles in the topmost layer is highly vulnerable to the abrasion marks and pressure marks.

In recent years, photographic processing time for the photographic light-sensitive material has been shortened. Especially, for the color paper, the processing time has been remarkably shortened utilizing an emulsion having high content ratio of silver chloride. When the processing time is shortened, the abrasion marks and pressure marks are liable to be formed. Therefore, improvements have been required wherein the light-sensitive material is more resistant to the abrasion marks and pressure marks.

The light-sensitive material in which a large amount of fine particles is put is highly vulnerable to the abrasion marks and pressure marks. Improvements in the abrasion resistance and pressure resistance have been highly required for the color paper because the product value is much lowered, if it is vulnerable to the abrasion marks and pressure marks in the shortened processing.

The silver halide photographic light-sensitive material for the postcards employing a thin RC paper having a thickness of about 100 to about 160 $\mu$m is more vulnerable to the abrasion marks and pressure marks than the conventional RC paper having a thickness of 200 to 240 $\mu$m.

Accordingly, it has been difficult to practice the addition of fine particles onto the surface or into the interior of the silver halide photographic light-sensitive material in order to obtain matting effect or writing susceptibility because of lowering the resistance to the abrasion marks and pressure marks during processing.

SUMMARY OF THE INVENTION

An object of the present invention is provide a silver halide photographic light-sensitive material which results in a print having an image in depth; has improved abrasion resistance and improved pressure resistance during processing, and is excellent in writing and stamping properties.

The present invention and its embodiments are described.

The silver halide photographic light-sensitive material of the present invention has at least one light-sensitive silver halide emulsion layer and at least one non-light-sensitive layer on a support. At least one non-light-sensitive layer contains porous fine particles of 400 mg per 1 $m^2$ or more and said material is hardened utilizing at least one of vinyl sulfone hardener, carboxyl-activating hardener or polymeric hardener.

In a silver halide photographic light-sensitive material, the silver halide photographic light-sensitive material wherein at least one light-sensitive silver halide emulsion layer and one non-light-sensitive hydrophilic colloid layer are coated on a support; the non-light-sensitive hydrophilic colloid layer which is positioned furthest from the support contains porous fine particles of 400 mg per 1 $m^2$ or more, and the swell ratio of said non-light-sensitive hydrophilic colloid layer comprising the porous fine particles in distilled water is lower than that of all layers constituting said silver halide photographic light-sensitive material in the distilled water.

The porous fine particle is preferably an inorganic compound.

The specially preferred example of the porous fine particle is silica.

In the case of a photographic light-sensitive material comprising a support having a resin layer on the surface, the center plane average roughness (SRa) of the resin layer on the side of a support on which a silver halide light-sensitive layer is coated is preferably 0.15 μm or more in the following Formula 1.

$$SRa = \frac{1}{S_A}\int_0^{Lx}\int_0^{Ly} |f(x, y)|\, dx dy \qquad \text{Formula1}$$

Wherein SRa represents the center plane average roughness; Lx represents the length of the X axis direction in the measurement plane region; Ly represents the length of the Y direction in the measurement plane region; $S_A$ represents the area of the measurement region; $S_A$=Lx×Ly. At the time, Lx=7.5 mm, Ly=21 mm; f(x, y) is a function expressing the roughness of a surface, and x and y represent each position coordinate of a measurement point in the x direction and the y direction, respectively.

The thickness of the support is preferably 100 μm or more and 160 μm. or less.

Among hardeners, a vinyl sulfone hardener is preferred.

DETAILED DESCRIPTION OF THE INVENTION

The present invention is explained in detail.

A silver halide photographic light-sensitive material comprises a light-sensitive layer having light-sensitive silver halides and a non-light-sensitive layer having no light sensitivity on a support. These layers contain high polymer compounds such as gelatin. The high polymer compound binds materials such as silver halide contained in the layer and thus, is sometimes referred to by the term "binder".

Examples of the non-light-sensitive layer include a protective layer which protects a light-sensitive layer and intermediate layers which absorb ultraviolet radiation and prevent color contamination in the case of color photography.

At least one of the light-sensitive layer and non-light-sensitive layer is hardened by any of a vinyl sulfone hardener, a carboxyl-activating hardener and a polymeric hardener.

At least one of the non-light-sensitive layers comprises porous fine particles. The non-light-sensitive layer is preferably a protective layer arranged as a topmost layer. The non-light-sensitive layer comprising the porous fine particles is well hardened and is adjusted so as to have less swell ratio than the other layers.

Fine particles of a high boiling point organic solvent such as dibutylphthalate and di-i-decylphthalate are preferably put into the protective layer.

The porous fine particles according to the present invention are fine particles having pores.

The porous fine particles are powder of a substance which can be dispersed into a hydrophilic binder and the average diameter is preferably from 0.1 to 10 μm and more preferably from 0.5 to 5 μm.

The porous fine particle powder may be employed individually or may be employed by mixing another porous fine particle powder. Organic porous fine particle powder includes natural and synthetic organic compounds such as cellulose esters, polymethylmethacrylate, polystyrene or polydivinylbenzene and these copolymers. The porous fine particle powder composed of inorganic compounds is preferred. The specific inorganic compounds include silica, alumina, aluminum hydroxide, titanium oxide, barium sulfate, calcium carbonate, magnesium sulfate, glass beads, synthetic mica, etc. Among these, silica is most preferred.

The specific surface area of the porous fine particle powder is preferably 100 $m^2$/g or more and more preferably 200 $m^2$/g or more. A maximum value of the specific surface area of the porous fine particle powder is usually 1,000 $m^2$/g. The average diameter of pores is preferably 300 Å or less and more preferably 250 Å or less. The specific area and pore diameter of the porous fine particle powder can be obtained using a gas adsorption method.

Methods for preparing the porous fine particle powder are described in U.S. Pat. Nos. 1,665,264, 1,935,176, 2,071,987, 2,459,903, 2,462,798, 2,469,314, 2,505,895, 2,685,569, 3,066,092, 4,070,286, etc. The porous fine particle powder is easily available on the market.

The addition amount of the porous fine particle powder in a silver halide photographic light-sensitive material is 400 mg or more per 1 $m^2$. The addition amount is preferably from 500 to 1,500 mg/$m^2$ and most preferably from 600 to 1,200 mg/$m^2$. An added layer is a non-light-sensitive hydrophilic colloid layer and preferably a non-light-sensitive hydrophilic colloid layer most apart from the support and specifically a protective layer.

The porous fine particle powder may be added directly to a coating solution which forms a non-light-sensitive hydrophilic colloid layer. However, it may be added preferably to a coating solution which forms a non-light-sensitive hydrophilic colloid layer after it is dispersed into water or a gelatin solution.

As means for dispersing the porous fine particle powder of the present invention into water or the gelatin solution, a mixer, a homogenizer, a colloid mill, a flow-jet mixer, an ultrasonic homogenizer, etc. may be employed.

Vinyl sulfone hardeners are explained. The vinyl sulfone hardeners have two or more vinylsulfon group represented by —CH═CHSO$_2$— in a molecule. The number of the vinylsulfon group is usually 2 to 6 and up to 8. They include, for example, (1) aromatic compounds as described in German Patent No. 1,100,942; (2) alkyl compounds combined with a hetero atom as described in Japanese Patent Publication Nos. 44-29622 and 47-2537; (3) sulfonamide and ester compounds as described in Japanese Patent Publication No. 47-8736; 1,3,5-tris[b-(vinylsulfonyl)-propionyl]-hexahydro-s-triazine as described in Japanese Patent Publication Open to Public Inspection No. 49-24435 or alkyl compounds as described in Japanese Patent Publication Open to Public Inspection No. 51-44164.

In the following, the representative compounds are illustrated.

HA-1

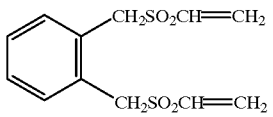

HA-2

$O(CH_2CH_2SO_2CH{=}CH)_2$

HA-3

$NH(CH_2CH_2SO_2CH{=}CH_2)_2$

HA-4

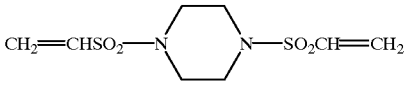

-continued

HA-5

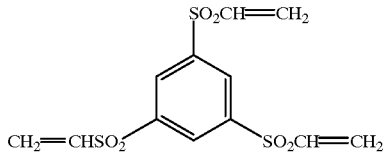

HA-6

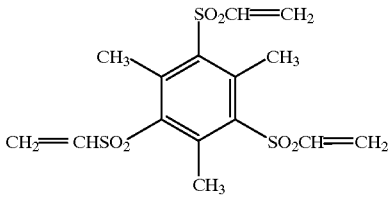

HA-7

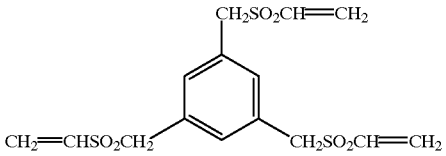

HA-8

$CH_3C(CH_2OCH_2SO_2CH{=}CH_2)_3$

HA-9

$C(CH_2OCH_2SO_2CH{=}CH_2)_4$

HA-10

$N(CH_2CH_2OCH_2SO_2CH{=}CH_2)_3$

HA-11

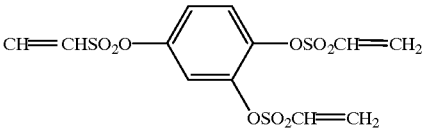

HA-12

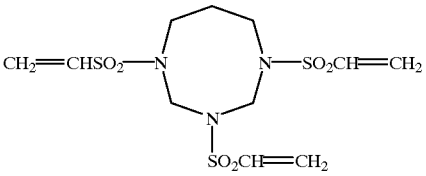

HA-13

$C_2H_5C(CH_2SO_2CH{=}CH_2)_3$

HA-14

$C_8H_{17}C(CH_2SO_2CH{=}CH_2)_3$

HA-15

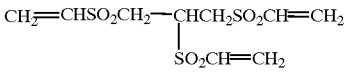

HA-16

$(CH_2{=}CHSO_2CH_2)_3CCH_2Br$

HA-17

$CH_2{=}CHSO_2CH_2)_2CHCH(CH_2SO_2CH{=}CH_2)_2$

HA-18

$(CH_2{=}CHSO_2CH_2)_3CCH_2OCH_2C(CH_2SO_2CH{=}CH_2)_3$

HA-19

$C(CH_2SO_2CH{=}CH_2)_4$

-continued

HA-20

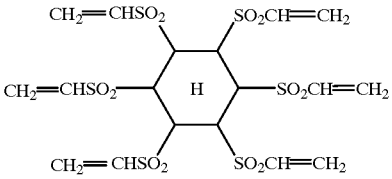

HA-21

$(CH_2{=}CHSO_2CH_2)_3CCH_2SO_2CH_2CH_2Cl$

HA-22

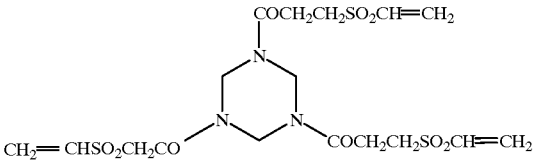

HA-23

$(CH_2{=}CHSO_2CH_2)_3C{-}CH_2SO_2CH_2CH_2NHCH_2CH_2CH_2SO_3K$

HA-24

$(CH_2{=}CHSO_2CH_2)_2C{-}(CH_2SO_2CH_2CH_2NHCH_2CH_2SO_3K)_2$

HA-25

$CH_2{=}CHSO_2CH_2CONHCH_2CH_2NHCOCH_2SO_2CH{=}CH_2$

HA-26

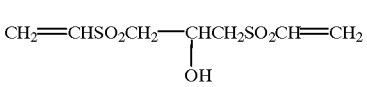

HA-27

$CH_2{=}CHSO_2CH_2OCH_2SO_2CH{=}CH_2$

HA-28

$CH_2{=}CHSO_2CH_2CH_2SO_2CH{=}CH_2$

HA-29

$CH_2{=}CHSO_2CH_2SO_2CH{=}CH_2$

HA-30

$(CH_2{=}CHSO_2)_2CHCH_2CH_2{-}C_6H_4{-}SO_3Na$

In addition to the above-illustrated vinyl sulfone hardeners, are included reaction products obtained by reacting a compound having at least three vinyl sulfone groups in the molecular structure such as, for example, the illustrated compounds HA-5 to 23 with a compound having a group which reacts with the vinyl sulfone group and a water-soluble group such as, for example, diethanolamine, thioglycollic acid, sarcosine sodium salt or taurine sodium salt.

The addition amount of the vinyl sulfone hardener is from 1.0 to 1,000 mg/m$^2$ for all the photographic composition layers of a silver halide photographic light-sensitive material and preferably from 10 to 500 mg/m$^2$. When converted to the amount per 1 g of gelatin, it is from about 0.1 to about 100 mg and preferably from 1 to 50 mg.

The synthesis methods of these vinyl sulfone hardeners are described in, for example, Japanese Patent Publication Nos. 47-2429 and 50-3580, and Japanese Patent Publication Open to Public Inspection Nos. 49-24435, 53-41221 and 59-18944.

The preferred vinyl sulfone hardeners are those that have three vinyl sulfone groups or more, more preferably three to four vinyl sulfone groups in the molecule.

Explanation is given regarding to carboxyl-activating hardeners. The carboxyl-activating hardeners react with free carboxyl groups of the protein containing binder so that they react with free amino groups to form peptide bonds. Therefore they are sometimes caclled as peptide reagent hardeners. The preferred examples of the carboxyl-activating hardener may include compounds represented by Formulas (1) to (4) and Formulas (6) to (8).

Formula (1)

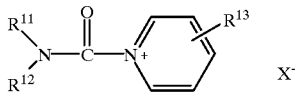

In Formula (1), $R^{11}$ and $R^{12}$ each represent an alkyl group having from 1 to 10 carbon atoms (for example, methyl, ethyl or 2-ethylhexyl), an aryl group having from 6 to 15 carbon atoms (for example, phenyl or naphthyl) or an aralkyl group having from 7 to 15 carbon atoms (for example, benzyl, phenethyl, and may be the same or different. Furthermore, it is preferred that $R^{11}$ and $R^{12}$ combine each other to form heterocyclic ring together with a nitrogen atom. Examples of rings formed include a pyrrolidine ring, a piperazine ring, morpholine ring, etc. $R^{13}$ represents a substituent such as a hydrogen atom, a halogen atom, a carbamoyl group, a sulfo group, a sulfoxy group, a sulfoamino group, a ureido group, an alkoxy group having from 1 to 10 carbon atoms, an alkyl group having from 1 to 10 carbon atoms, a dialkyl substituted amino group having from 2 to 20 carbon atoms, etc. When $R^{13}$ is an alkoxy group, an alkyl group, a dialkylamino group, or an N-alkylcarbamoyl group, any of these groups may have a substituent. The examples include a halogen atom, a carbamoyl group, a sulfo group, a sulfoxy group, a sulfoamino group or a ureido group. $X^-$ represents an anion and is a counter ion of N-carbamoylpyridinium salt. When the substituent of $R^{13}$ includes a sulfo group, a sulfoxy group or a sulfoamino group, $X^-$ may not be present upon forming an inner salt. The preferred examples of the anion include a halide compound ion, sulfate ion, sulfonate ion, $ClO_4^-$, $BF_4^-$, $PF_6^-$, etc.

The carbamoyl ammonium salt hardeners represented by formula (1) are described in Japanese Patent Publication Nos. 56-12853 and 58-32699, and Japanese Patent Publication Open to Public Inspection Nos. 49-51945, 51-59625, 61-9641, etc.

Formula (2)

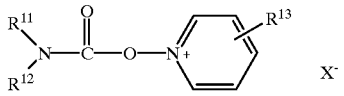

In Formula (2), the definition of $R^{11}$, $R^{12}$, $R^{13}$ and $X^-$ is the same as that in the formula (1). These compounds are described in Belgium Patent No. 825,726.

Formula (3)

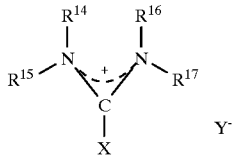

In Formula (3), $R^{14}$, $R^{15}$, $R^{16}$ and $R^{17}$ each are an alkyl group having from 1 to 20 carbon atoms (for example, methyl, ethyl, butyl, 2-ethylhexyl, dodecyl), an aralkyl group having from 6 to 20 carbon atoms (for example, benzyl, phenethyl, 3-pyridylmethyl) or an aryl group having from 5 to 20 carbon atoms (for example, phenyl, naphthyl, pyridyl) and the same or different. Furthermore, $R^{14}$, $R^{15}$, $R^{16}$ and $R^{17}$ may have a substituent. The examples of the substituent include a halogen atom, an alkoxy group having from 1 to 20 carbon atoms, an aryloxy group having from 1 to 20 carbon atoms, an N,N-di substituted carbamoyl group, etc.

It is preferred that any two of $R^{14}$, $R^{15}$, $R^{16}$ and $R^{17}$ combine to form a ring. Examples wherein $R^{14}$ and $R^{15}$ or $R^{16}$ and $R^{17}$ combine to form a ring together with a nitrogen atom include a pyrrolidine ring, a piperazine ring, a perhydroazepine ring, a morpholine ring, etc. Furthermore, examples wherein $R^{14}$ and $R^{15}$ or $R^{16}$ and $R^{17}$ combine to form a ring together with two nitrogen atoms and a carbon atom between the nitrogen atoms include an imidazoline ring, a tertahydropyrimidine ring, a tetrahydrodiazepine ring, etc.

X represents a group which can be released when a compound represented by Formula (3) reacts with a nucleophilic reagent. Preferred examples include a halogen atom, a sulfo group, etc. $Y^-$ represents an anion and is preferably a halide compound ion, a sulfonate ion, a sulfate ion, $ClO_4^-$, $BF^-$, $PF_6^-$, etc. When Y represents the sulfonate ion, it may combine with X, $R^{14}$, $R^{15}$, $R^{16}$ or $R^{17}$ to form an inner salt.

Amidinium salt hardeners represented by Formula (3) are described in Japanese Patent Publication Open to Public Inspection No. 60-225148.

Formula (4)

$$R^{18}—N=C=N—R^{19}$$

In Formula (4), $R^{18}$ represents an alkyl group having from 1 to 10 carbon atoms (for example, methyl, ethyl, 2-ethylhexyl), a cycloalkyl group having from 5 to 8 carbon atoms (for example, cyclohexyl), an alkoxyalkyl group having from 3 to 10 carbon atoms (for example, methoxyethyl) or an aralkyl group having from 7 to 15 carbon atoms (for example, benzyl, phenethyl). $R^{19}$ represents groups defined for $R^{18}$ and in addition, represents preferably groups represented by Formula (5).

Formula (5)

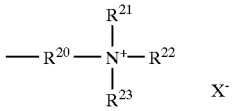

In Formula (5), $R^{20}$ represents an alkylene group having from 2 to 4 carbon atoms (for example, ethylene, propylene, trimethylene, etc.). $R^{21}$ and $R^{22}$ each represent an alkyl group having from 1 to 6 and may be the same or different. Furthermore, it is preferred that $R^{21}$ and $R^{22}$ combine to form a heterocyclic ring together with a nitrogen atom (for example, pyrrolidine ring, a piperzine ring, a morpholine ring, etc.) $R^{23}$ represents an alkyl group having from 1 to 6 carbon atoms and is preferably substituted. Examples of the substituent include preferably a substituted or unsubstituted carbamoyl group, a sulfo group, etc. $X^-$ represents an anion and is preferably a halide compound ion, a sulfonate ion, sulfur ion, $ClO_4^-$, $BF_4^-$, $PF_6^-$, etc. Furthermore, when $R^{23}$ is substituted with a sulfo group, $X^-$ may not be present upon forming an inner salt.

Carbodiimide hardeners are described in Japanese Patent Publication Open to Public Inspection No. 51-126125.

Formula (6)

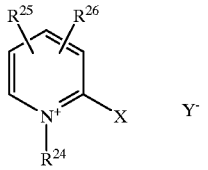

In Formula (6), $R^{24}$ represents an alkyl group having from 1 to 10 carbon atoms (for example, methyl, ethyl, butyl), an aryl group having from 6 to 15 carbon atoms (for example, phenyl, naphthyl) or an aralkyl group having from 7 to 15 carbon atoms (for example, benzyl, phenethyl). These groups may be substituted and examples of the substituent include a carbamoyl group, a sulfamoyl group, a sulfo group, etc. $R^{25}$ and $R^{26}$ each represent a substituent such as a hydrogen atom, a halogen atom, an acylamide group, a nitro group, a carbamoyl group, a ureido group, an alkoxy group, an alkyl group, an alkenyl group, an aryl group, an aralkyl group, etc. and are the same or different. Furthermore, $R^{25}$ and $R^{26}$ may combine to form a condensation ring together with a pyridinium ring skeleton.

X represents a group which is releasable when a compound represented by Formula (6) reacts with a nucleophilic agent. Preferred examples include a halogen atom, a sufonyloxy group or a group represented by $—OP(=O(OR^{27})_2$, wherein $R^{27}$ represent an alkyl group or an aryl group. When X represents the sulfonyloxy group, $R^{24}$ may preferably be combined. $Y^-$ represents an anion and is preferably a halide compound ion, a sulfonate ion, a sulfate ion, $ClO_4^-$, $BF_4^-$, $PF_6^-$, etc. Furthermore, When $R^{24}$ is substituted with the sulfo group, Y may not be present upon forming an inner salt.

Pyridinium salt type hardeners are described in Japanese Patent Publication No. 58-50699 and Japanese Patent Publication Open to Public Inspection Nos. 57-44140 and 57-46538.

Formula (7)

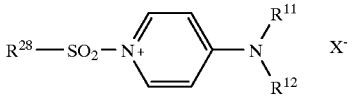

In Formula (7), the definition of $R^{11}$ and $R^{12}$ is the same as that of $R^{11}$ and $R^{12}$ in Formula (1) and $R^{28}$ represents an alkyl group having from 1 to 10 carbon atoms (for example, methyl, ethyl, butyl), an aryl group having from 6 to 15 carbon atoms (for example, phenyl, naphthyl) or an aralkyl group having from 7 to 15 carbon atoms (benzyl, phenethyl). $X^-$ is an anion and is preferably a halide compound ion, a sulfonate ion, a sulfate ion, $ClO_4^-$, $BF_4^-$, $PF_6^-$, etc.

The pyridinium salt series hardeners represented by Formula (7) are described in Japanese Patent Publication Open to Public Inspection No. 52-54427.

Formula (8)

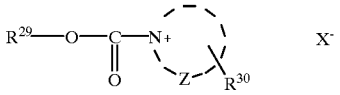

In Formula (8), $R^{29}$ represents an alkyl group having from 1 to 10 carbon atoms (for example, methyl, ethyl, 2-ethylhexyl), an aryl group having from 6 to 15 carbon atoms (for example, phenyl, naphthyl), or an aralkyl group having from 7 to 15 carbon atoms (for example, benzyl, phenethyl, etc.) and these groups may be substituted or unsubstituted. The substituents include a halogen atom, a carbamoyl group, a sulfo group, a sulfoxy group, a ureido group, an alkoxy group having from 1 to 10 carbon atoms, an alkyl group having from 1 to 10 carbon atoms, a dialkyl substituted amino group having from 2 to 20 carbon atoms, etc.

Z represents a nonmetallic atom group required for forming a heterocyclic aromatic ring containing a nitrogen atom and preferred examples include a pyridine ring, a pyrimidine ring, a pyrazole ring, an imidazole ring, an oxazole ring, etc. and those benzo condensation ring. $R^{30}$ represents a hydrogen atom, a halogen atom, a carbamoyl group, a sulfo group, a sulfoxy group, a ureido group, an alkoxy group having from 1 to 10 carbon atoms, an alkyl group having from 1 to 10 carbon atoms or a dialkyl substituted amino group having from 2 to 20 carbon atoms. When $R^{30}$ is an alkoxy group, an alkyl group, a dialkylamino group or an N-alkylcarbamoyl group, these groups may be substituted. Examples of these substituents include a halogen atom, a carbamoyl group, a sulfo group, a sulfoxy group, and an ureido group. $X^-$ represents an anion. When $R^{29}$, $R^{30}$ or those substituents contain a sulfo group or a sulfoxy group, $X^-$ may not be present upon forming an inner salt. The preferred examples of the anion include a halide compound ion, a sulfate ion, a sulfonate ion, $ClO_4^-$, $BF_4^-$, $PF_6^-$, etc.

The other examples of the carboxyl-activating hardeners are found in U.S. Pat. No. 4,978,607.

As carboxyl-activating hardeners in addition to the compounds represented by the above-mentioned Formulas (2) to (4) and (6) to (8), are preferable compounds as those described in Japanese Patent Publication Open to Public Inspection Nos. 50-38540, 52-93470, 56-43353, 58-113929 and U.S. Pat. No. 3,321,313. Particularly preferred hardeners employed in the present invention are those represented by Formula (2). In the following, specific examples of the compound employed in the present invention are illustrated.

a. Examples of compound represented by Formula (1)

HB-1

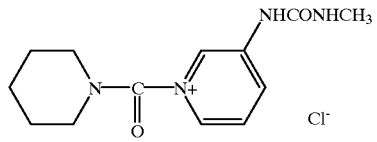

-continued
HB-2
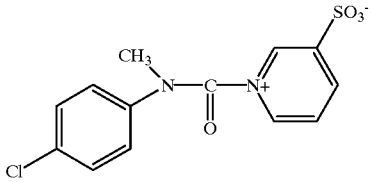
HB-3
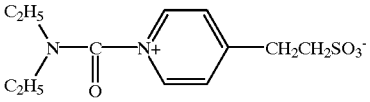
HB-4
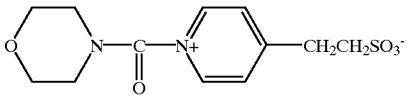
HB-5
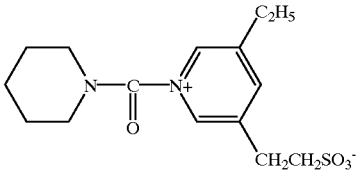
HB-6
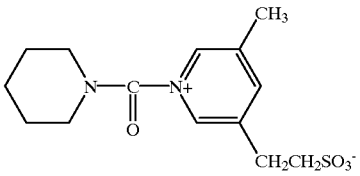
HB-7
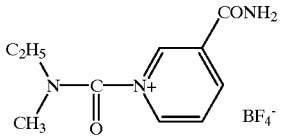
HB-8
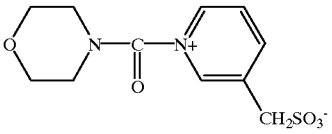
HB-9
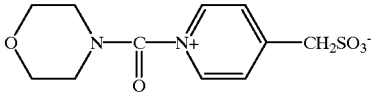
HB-10
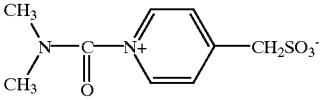
-continued
HB-11
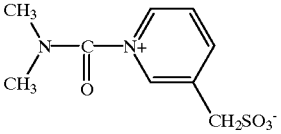
HB-12
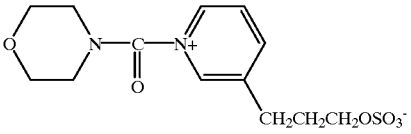
HB-13
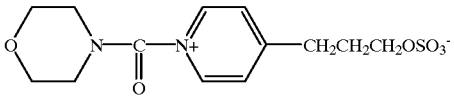
HB-14
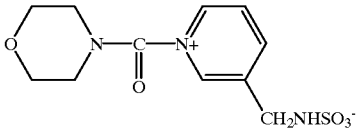
HB-15
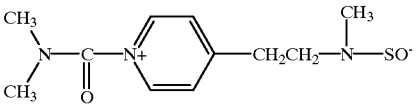
HB-16
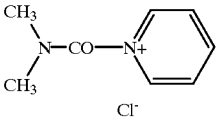
HB-17
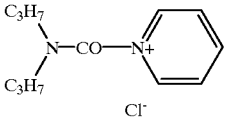
HB-18
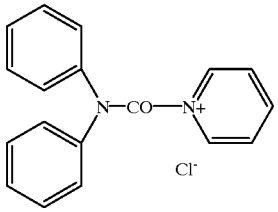
HB-19
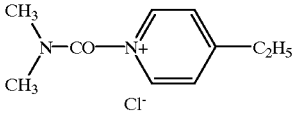

-continued
HB-20
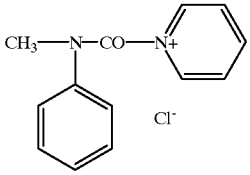
HB-21
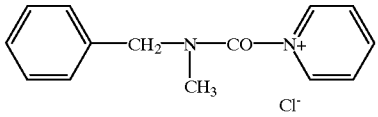
HB-22
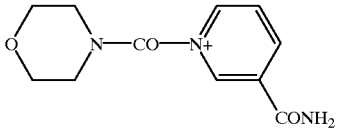
HB-23
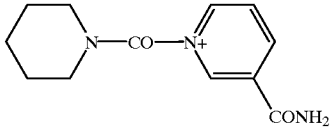
HB-24
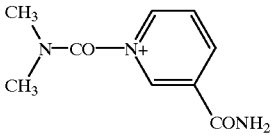
HB-25
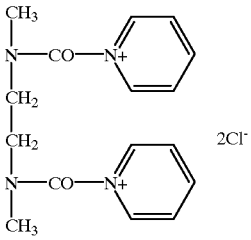
HB-26
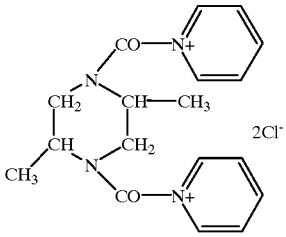
-continued
HB-27
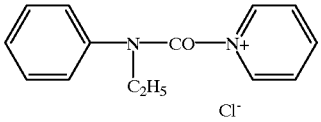
HB-28
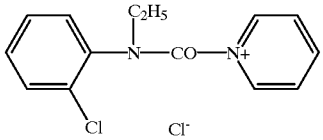
HB-29
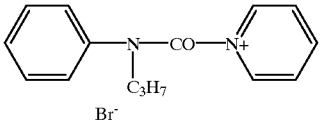
HB-30
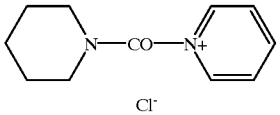
HB-31
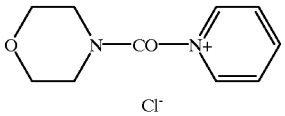
HB-32
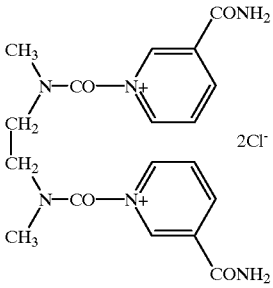
HB-33
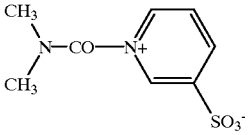
HB-34
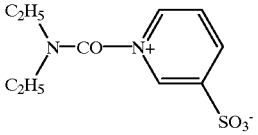

-continued
HB-35
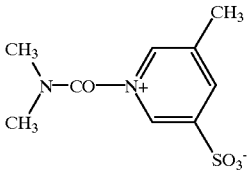
HB-36
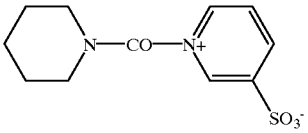
HB-37
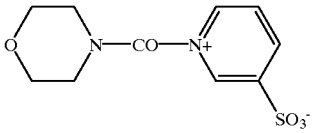
HB-38
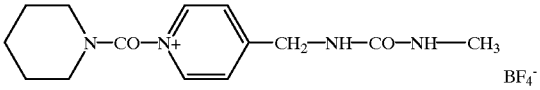
HB-39
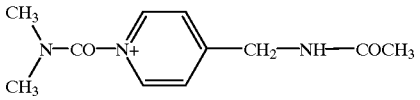
HB-40
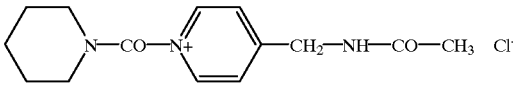
HB-41
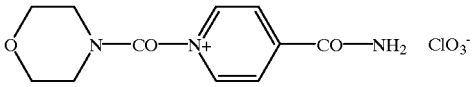
HB-42
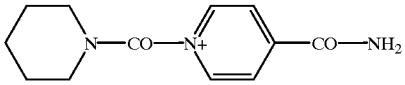
HB-43
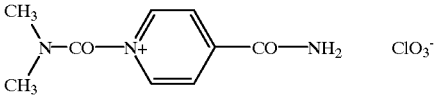
HB-44
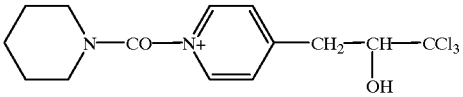
HB-45
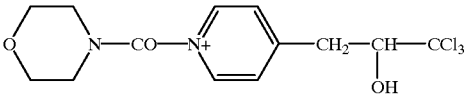
-continued
HB-46
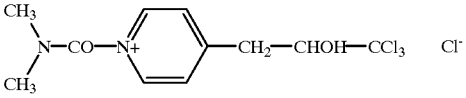
HB-47
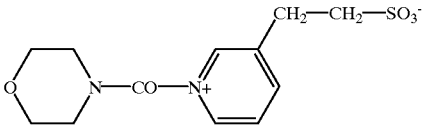
HB-48
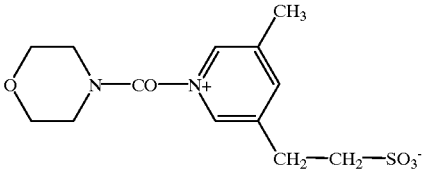
HB-49
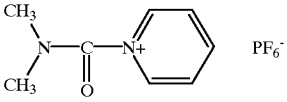
HB-50
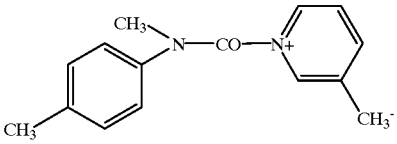
HB-51
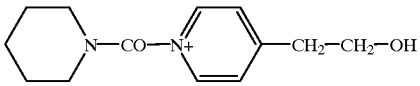
HB-52
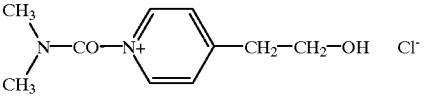
HB-53
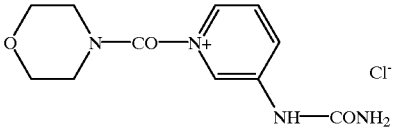
HB-54
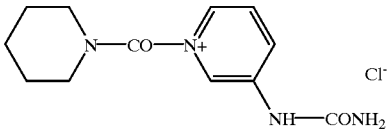
HB-55
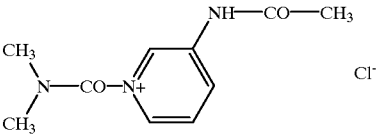

-continued
HB-56
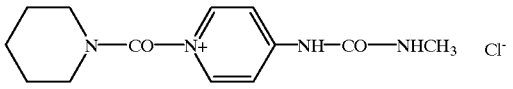
HB-57
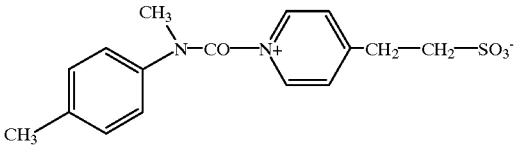
HB-58
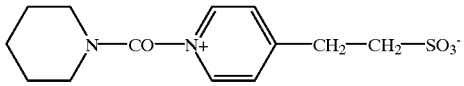
HB-59
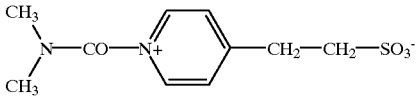
HB-60
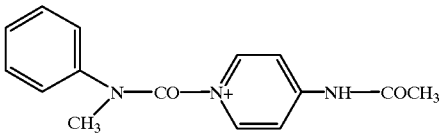
HB-61
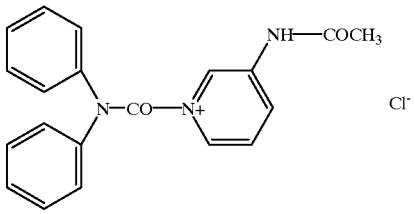
HB-62
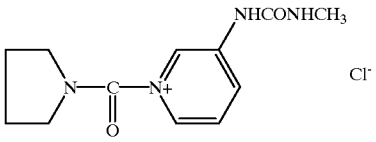
HB-63
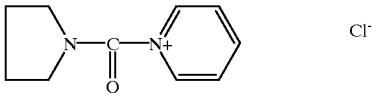
HB-64
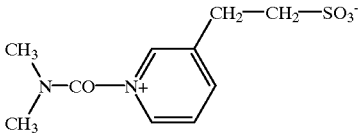
b. Examples of compound represented by Formula (2)
HB-65
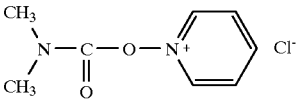
HB-66
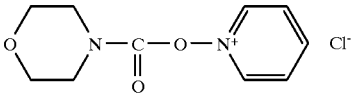
c. Examples of compound represented by Formula (3)
HB-67
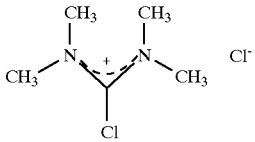
HB-68
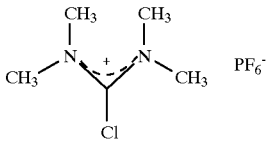
HB-69
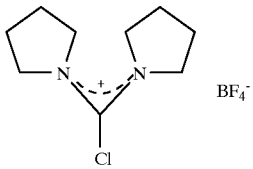
HB-70
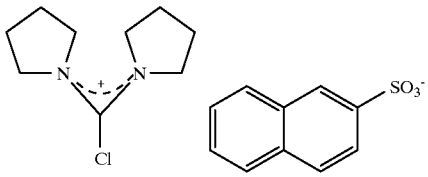
HB-71
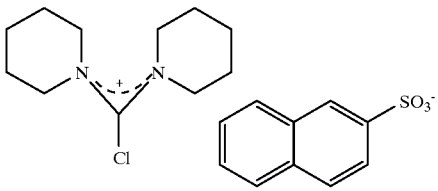
HB-72
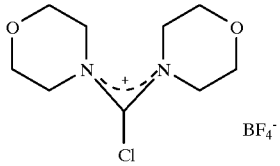

-continued

HB-73

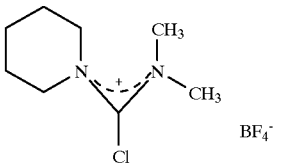

HB-74

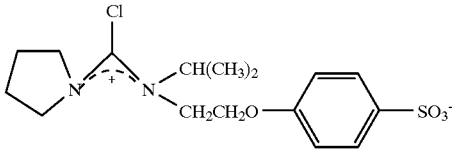

d. Example of compound represented by Formula (4)

HB-75

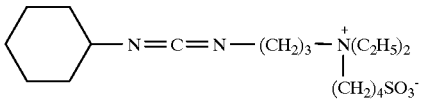

e. Example of compound represented by Formula (6)

HB-76

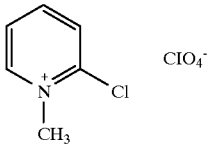

f. Examples of compound represented by Formula (7)

HB-77

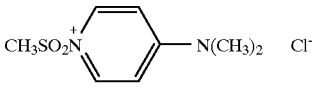

HB-78

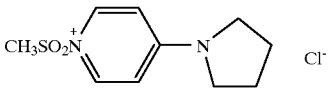

g. Examples of compound represented by Formula (8)

HB-79

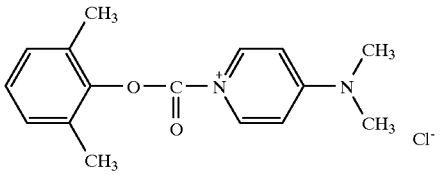

-continued

HB-80

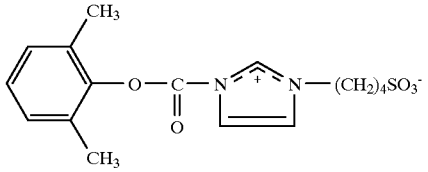

h. Compound described in Japanese Patent Publication Open to Public Inspection No. 50-38540

HB-81

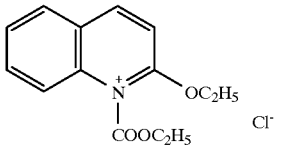

i. Compound described in Japanese Patent Publication Open to Public Inspection No. 52-93470

HB-82

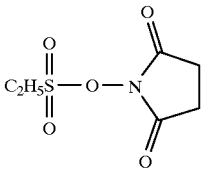

j. Compound described in Japanese Patent Publication Open to Public Inspection No. 56-43353

HB-83

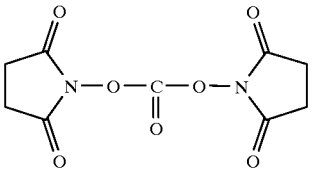

k. Compound described in Japanese Patent Publication Open to Public Inspection No. 58-113929

HB-84

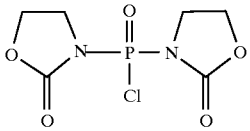

1. Compound described in U.S. Pat. No. 3,321,313

HB-85

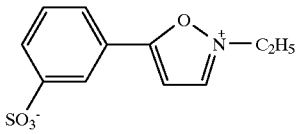

The addition amount of the carboxyl-activating hardener may be adjusted according to its purpose. Generally, the addition amount may be from 0.01 to 20 weight percent of dry gelatin. Particularly preferably is used 0.05 to 15 weight percent.

Polymeric hardeners are explained. The polymeric hardeners have been well known through patents such as Japanese Patent Publication Open to Public Inspection No. 56-66841, British Patent No. 1,322,971, U.S. Pat. No. 3,671,256, etc. and books such as Burness D. M. and Pouradier J. in The Theory of the Photographic Process, 4th ed.; James T. H., Ed.; Macmillan Publishing; 1977; p 84, and Campbell, et al.; Polymeric Amine and Ammonium Salts; Pergamon Press; 1979; pp 321–332, etc. The polymeric hardeners are resistant to diffusion because they are composed of high polymers. Accordingly, when added to a layer, they are not liable to move out of the layer. Thus, they are preferably employed to harden a desired layer.

Preferred examples of the polymeric hardener are illustrated by general formulas HP-I, HP-II or HP-III.

HP-I

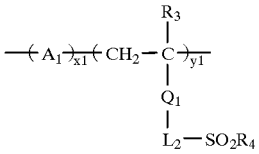

HP-II

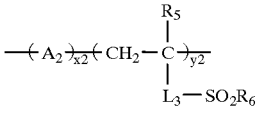

HP-III

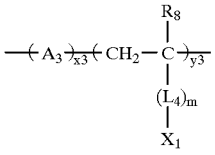

In HP-I, $A_1$ represents an ethylenic unsaturated monomer which can polymerize with a monomer unit shown in the right side.

Furthermore, in the formula, $R_3$ represents a hydrogen atom, a lower alkyl group having from 1 to 6 carbon atoms. $Q_1$ represents any of —$CO_2$—, —CO—N($R_3$)— ($R_3$ represents the same as those above-mentioned.), or an arylene group having from 6 to 10 carbon atoms. $L_2$ represents either a divalent group having from 3 to 15 carbon atoms which contains at least one of bonds of —$CO_2$—, —CO—N($R_3$)— ($R_3$ represents the same as those above-mentioned.) or a divalent group having from 1 to 12 carbon atoms which contains at least one of bonds of —O—, —N($R_3$)—, —CO—, —SO—, —$SO_2$—, —$SO_3$—, —$SO_2$N($R_3$)—, —N($R_3$)—, —N($R_3$)CON($R_3$)—, —N($R_3$)$CO_2$— ($R_3$ represents the same as those above-mentioned.). $R_4$ represents a vinyl group, a functional group which is its precursor and is any of —CH=$CH_2$, =$CH_2CH_2X_1$. $X^1$ represents a group which can be substituted by a nucleophilic group or a group which can be released with a base in a form of $HX^1$.

In the formula, $x_1$ and $y_1$ each represents mole percentage ratio and $x_1$ takes a value from 0 to 99 and $y_1$ takes a value from 1 to 100.

$Q_1$ represents the following groups.

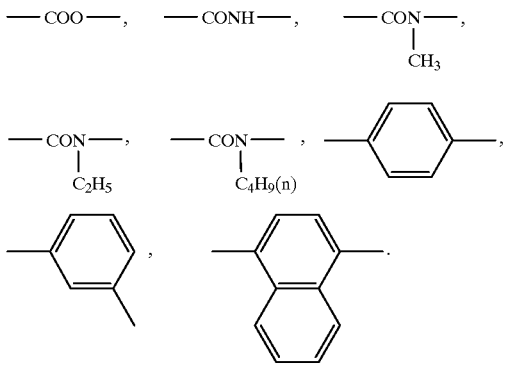

$L_1$ represents the following groups.

—$CH_2COOCH_2$—
—$CH_2COOCH_2CH_2$—
—$CH_2CH_2COOCH_2CH_2$—
—$(CH_2)_5COOCH_2CH_2$—
—$(CH_2)_{10}COOCH_2CH_2$—
—$CH_2NHCOCH_2$—
—$CH_2NHCOCH_2CH_2$—
—$(CH_2)_3NHCOCH_2CH_2$—
—$(CH_2)_3NHCOCH_2CH_2$—
—$(CH_2)_{10}NHCOCH_2CH_2$—
—$CH_2OCH_2$—
—$CH_2CH_2OCH_2CH_2CH_2$—
—$N(CH_3)CH_2CH_2$—
—$CH_2N(CH_3)CH_2CH_2$—
—$COCH_2CH_2$—
—$CH_2COCH_2CH_2$—
—$COC_6H_4$(p)—$CH_2$—
—$SO_2CH_2CH_2$—
—$CH_2SOCH_2CH_2$—
—$SO_2CH_2CH_2$—
—$SO_2CH_2CH_2SO_2CH_2CH_2$—
—$SO_2CH_2CH_2SO_2CH_2C(OH)HCH_2$—
—$SO_3CH_2CH_2CH_2$—
—$SO_3CH_2CO_2CH_2CH_2$—
—$SO_3CH_2CH_2CO_2CH_2CH_2$—
—$SO_2NHCH_2CO_2CH_2CH_2$—
—$SO_2NHCH_2CH_2COP_2CH_2CH_2$—
—$NHCOCONHCH_2CH_2$—
—$CH_2NHCONHCH_2CH_2$—
—$NHCO_2CH_2CH_2$—
—$CH_2NHCOCH_2CH_2$—

$R_4$ represents the following groups.

—CH=$CH_2$, —$CH_2CH_2Cl$, —$CH_2CH_2Br$, —$CH_2CH_2O_3SCH_3$,

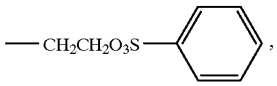

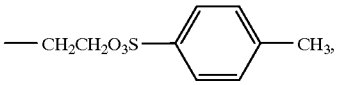

—$CH_2CH_2OH$, —$CH_2CH_2O_2CCH_3$, —$CH_2CH_2O_2CCF_3$, —$CH_2CH_2O_2CCHCl_2$.

In HP-II, $A_2$ represents the same as $A_1$; $R_5$ represents the same as $R_3$ and $R_6$, represents the same as $R_4$.

$L_3$ is a chemical bond selected from alkylene (chemical bond selected preferably from, alkylene having from 1 to 6 carbon atoms, for example, methylene, ethylene, isobutylene, etc.), arylene having from 6 to 12 carbon atoms (for example, a chemical bond selected from phenylene, trylene, naphthalene) or —$COZ^1$— or $COZ^1R_7$— ($R_7$ herein is alkylene having from 1 to 6 carbon atoms or arylene having from 6 to 12 carbon atoms and $Z^1$ is an oxygen atom or —NH—). $x_2$ and $y_2$ represent mole percentage, and $x_2$ takes a value from 10 to 95 percent and $y_2$ takes a value from 5 to 90 percent.

In HP-III, $A_3$ represents the same as $A_1$, and $R_8$ represents the same as $R_3$. $L_4$ represents a divalent chemical bond having from 1 to 20 carbon atoms (more preferably, a divalent group having from 1 to 12 carbon atoms comprising at least one of —CONH— or =CO—), and $X_1$ represents an active ester group. $x_3$ and $y_3$ represent mole percentage, and takes a value from 0 to 95 and $y_3$ takes a value from 5 to 100, and m is 0 or 1.

Examples of an ethylenic unsaturated monomer represented by $A_1$, $A_2$ or $A_3$ include ethylene, propylene, 1-butene, isobutene, styrene, chloromethylstyrene, hydroxymethylstyrene, sodium vinylbenzene sulfonate, sodium vinylbenzyl sulfonate, N,N,N-trimethyl-N-vinylbenzyl ammonium chloride, N,N-dimethyl-N-benzyl-N-vinylbenzyl ammonium chloride, a-methylstyrene, vinyltoluene, 4-vinylpyridine, 2-vinylpyridine, benzylvinylpyridinium chloride, N-vinylacetoamide, N-vinylpyrrolidone, 1-vinyl-2-methylimidazole, monoethylenic unsaturated ester of aliphatic acid, ethylenic unsaturated monocarboxylic acid or dicarboxylic acid or its salt, maleic anhydride, ester of ethylenic unsaturated monocarboxylic acid or dicarboxylic acid, amide of ethlyenic unsaturated monocarboxylic acid or dicarboxylic acid and the like.

When the polymer hardener is employed as a crosslinked latex, as $A_1$, in addition to the above-mentioned ethylenic unsaturated monomer, is employed the monomer having at least two or more of copolymerizable ethylenic unsaturated monomer (for example, divinylbenzene, methylene bisacrylamide, ethylene glycol diacrylate, trimethylene glycol acrylate, ethylene glycol dimethacrylate, trimethylene glycol dimethacrylate, neopentiglycol dimethacrylate, etc.)

Examples of $R_3$, $R_5$ or $R_8$ include a methyl group, an ethyl group, a butyl group and a n-hexyl group.

$L_4$ in HP-III represents the following groups.

—$CONHCH_2$—
—$CONHCH_2CH_2$—
—$CONHCH_2CH_2CH_2$—
—$CONHCH_2CH_2CH_2CH_2CH_2$—
—$COCH_2CH_2OCOCH_2CH_2$—
—$CONHCH_2CONHCH_2$—
—$CONHCH_2CONHCH_2CONHCH_2$—
—$COCH_2$—
—$CONHCH_2NHCOCH_2CH_2SCH_2CH_2$—
—$CONHCH_2OCOCH_2CH_2$— and the like.

$X_1$ in HP-III represents the following groups.

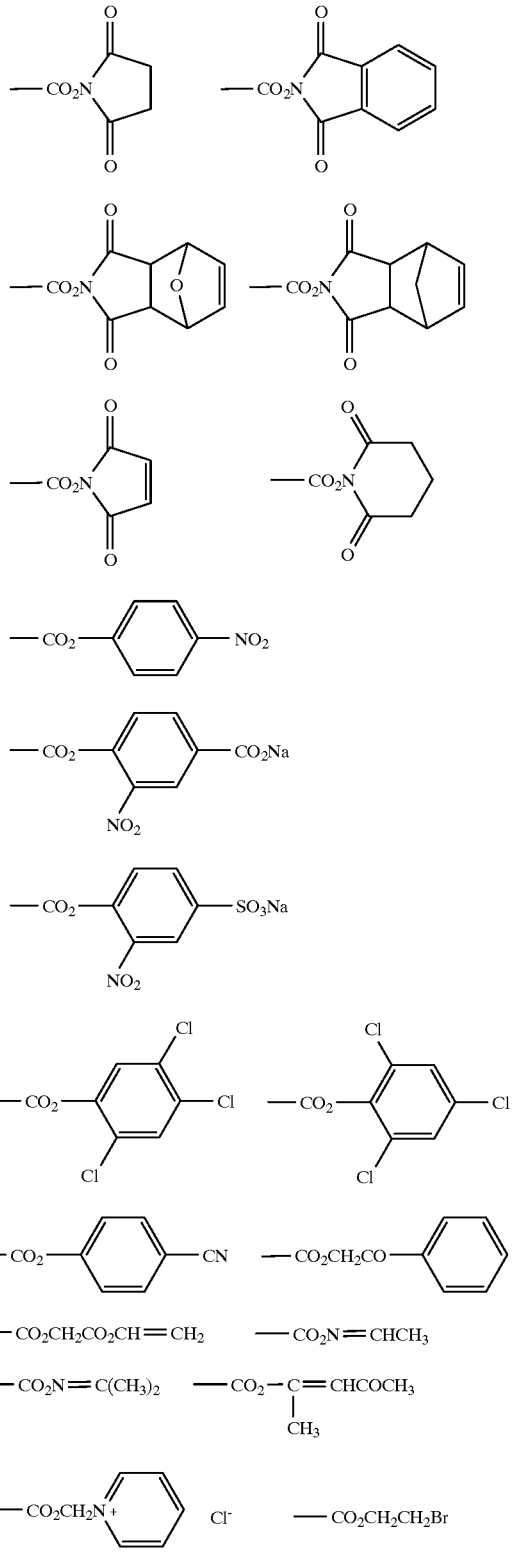

-continued
$-CO_2CH_2CH_2CN$ $-CO_2CH_2CH_2N^+(CH_3)_3\ Cl^-$
$-CO_2CH_2CN$, $-CO_2CH_2CO_2C_2H_2$, $-CO_2CH_2CONH_2$,
-continued
$-CO_2CH_2COCH_2$, etc.
In the following, are shown specific examples of the compound which may be employed in the present invention.
HP-1
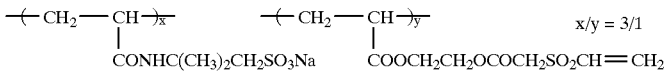
x/y = 3/1
HP-2
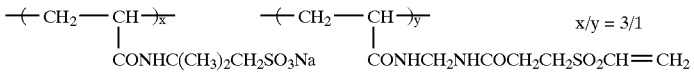
x/y = 3/1
HP-3
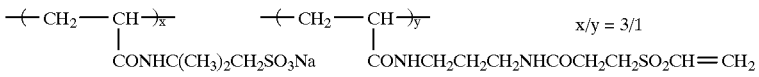
x/y = 3/1
HP-4
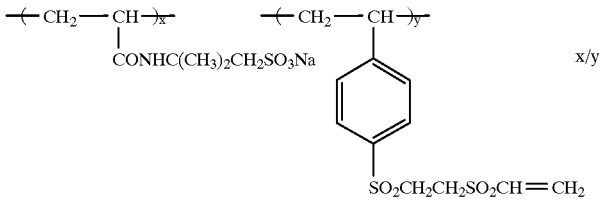
x/y = 3/1
HP-5
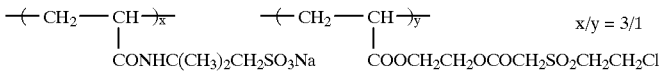
x/y = 3/1
HP-6
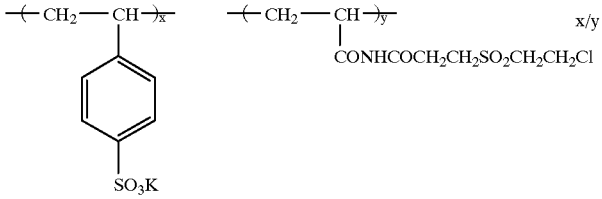
x/y = 3/1
HP-7
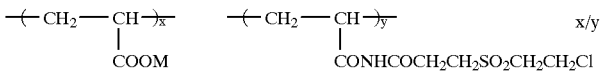
x/y = 10/1
HP-8
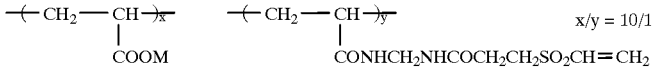
x/y = 10/1
HP-9
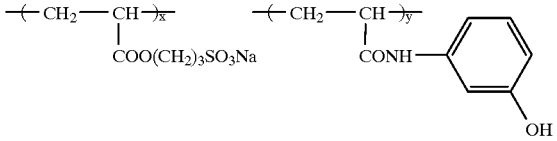
x/y = 3/1

-continued

HP-10

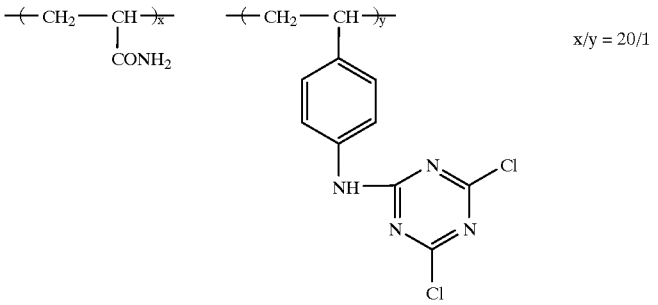

x/y = 20/1

HP-11

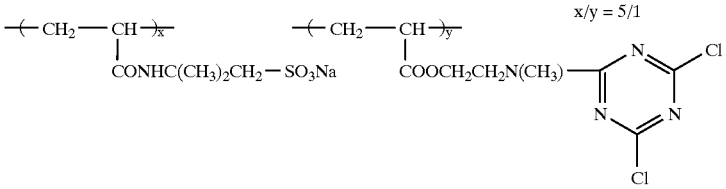

x/y = 5/1

HP-12

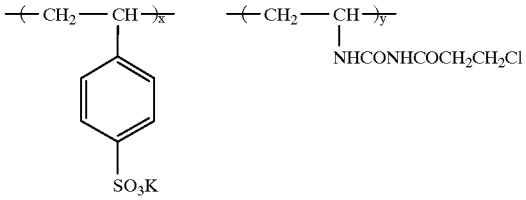

x/y = 10/1

HP-13

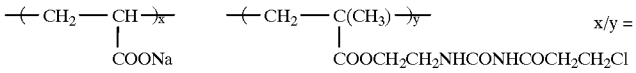

x/y = 5/1

HP-14

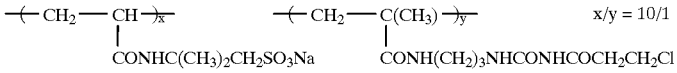

x/y = 10/1

HP-15

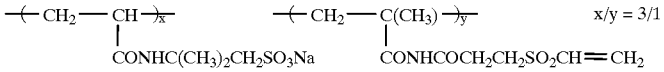

x/y = 3/1

M is a hydrogen atom, a sodium atom, or a potassium atom, and x and y each are mole ratio at the preparation of each unit and are not limited to the above-mentioned.

The addition amount of the polymeric hardener is from 10 to 2,000 mg/m$^2$ on the photographic composition layers of a silver halide photographic light-sensitive material and preferably from 20 to 1,000 mg/m$^2$. The addition amount, when converted to per one gram of gelatin, is from about 1 to about 200 mg.

The hardener may be added to a coating solution in advance or may be mixed with the coating solution just before coating.

The hardener may be added to all the photographic composition layers coated on a support or may be added to any of the layers (added to one or a plurality of layers). The hardener is preferably added to a non-light-sensitive hydrophilic colloid layer to which the porous fine particle powder is added.

As mentioned above, the hardener may be employed individually or in combination of two or more of the present invention. The hardener of the present invention may be employed together with other hardeners which have been known. The known hardeners include, for example, aldehyde compounds such as formaldehyde, glutaraldehyde, etc.; ketone compounds such as diacetyl, cyclopentadione; reactive halogen containing compounds such as bis(2-chloroethyl urea), 2-hydroxy-4,6-dichloro-1,3,5-triazine and in addition, compounds described in U.S. Pat. Nos. 3,288,775, 2,732,303 and British Patent Nos. 974,723 and 1,167,207, etc.; reactive olefin containing compounds such as 5-acetyl-1,3-diacryloilhexahydro-1,3,5-triazine and compounds described in U.S. Pat. Nos. 3,635,718, 3,232,763 and British Patent No. 994,869, etc.; N-methylol compounds such as N-hydroxymethylphthalimide and compounds described in U.S. Pat. Nos. 2,732,316, 2,586,168, etc.; isocyanates described in U.S. Pat. No. 3,103,437, etc.; aziridines described in U.S. Pat. Nos. 3,017,280, 2,983,611, etc.; acid derivatives described in U.S. Pat Nos. 2,725,294, 2,725,295, etc.; epoxy compounds and halogen carboxyaldehyes such as mucochloric acid described in U.S. Pat. No. 3,091,537, etc.

Or inorganic hardeners include chrome alum, zirconium sulfate, etc. Instead of the above-mentioned compounds, some take the structure of a precursor. For example, it may be employed together with an alkali metal bisulfite aldehyde addition compound, a methylol of hydantoin, a primary aliphatic nitroalcohol, a methyloxyethylsulfonyl, a chlorethylsulfonyl, etc. When the hardener of the present invention is employed together with another hardener, the mixing ratio of the hardener of the present invention may be adjusted optionally. However, the mixing ratio of the hardener of the present invention is preferably 50 mole percent or more.

Various methods are considered for measuring the swell ratio of a light-sensitive material. The thickness of each of layers constituting the light-sensitive material can be measured using a Cryo SEM method.

The Cryo SEM method is conducted as follows. A sample is immersed in a solution kept at a constant temperature for a specified period of time and is then frozen immediately in liquid nitrogen. The frozen sample is observed under a scanning electron microscope (SEM) and the thickness of the swelled layer is measured. According to the measured thickness, the swell ratio is derived.

The swell ratio of all layers constituting the light-sensitive material of the present invention can be calculated by a/b wherein a is the thickness of all layers after the immersion in distilled water at 25° C. for 3 minutes and b is the thickness prior to the immersion in distilled water.

The swell ratio of the non-light-sensitive hydrophilic colloid layer comprising the porous fine particle powder can be calculated by a'/b' wherein a' is the thickness of the non-light-sensitive hydrophilic colloid layer after the immersion in distilled water at 25° C. for 3 minutes and b' is the thickness of said non-light-sensitive hydrophilic colloid layer prior to the immersion in the distilled water.

The swell ratio a/b of all the layers constituting the photosensitive material of the present invention is termed S and the swell ratio a'/b' of the non-light-sensitive hydrophilic colloid layer of the present invention is termed S'. In the present invention, $S \geqq S'$ and $S'/S \leqq 1$. In the present invention, the addition amount of a hardener is adjusted so that $S'/S \leqq 0.9$ is held. Since silica is liable to absorb water, hardening gelatin in the topmost layer is adjusted so as to be harder than the other layers.

As a support used for the silver halide photographic light-sensitive material of the present invention, any materials can be used. Paper laminated with polyethylene and polyethylene terephthalate, paper support comprises natural pulp or synthetic pulp, a vinyl chloride sheet, propyrene which may contain a white pigment, polyethylene terephthalate support and a baryta paper can be used. Of these, a support having a water-proof resin laminated layer on both base paper is preferable. As a water-proof resin, polyethylene, polyethylene terephthalate or its copolymer are preferable.

As a white pigment used for a support, an inorganic and/or organic white pigment may be used. The preferable is an inorganic white pigment. For example, sulfates of an alkaline earth metal such as barium sulfate, carbonate of an alkaline earth metal such as calcium carbonate, silicas such as fine powder silicate and synthetic silicate salt, calcium silicate, alumna, alumna hydrate, titanium oxide, zinc oxide, talc and clay are used. The white pigment is preferably barium sulfate and titanium oxide.

The amount of white pigment contained in a water-proof resin layer on the surface of a support is preferably 13 wt % to 15 wt % of whole resin layer, from viewpoint of improving sharpness.

The degree of dispersion of the white pigment in a water-proof resin layer in paper support of the present invention can be measured by a method described in Japanese Patent O.P.I. Publication No. 28640/1990. When measured by means of aforesaid method, the degree of dispersion of white pigment is preferably 0.20 or less and more preferably 0.15 or less in terms of variation coefficient described in aforesaid specification.

The average roughness on the central plane of the support (SRa) is preferably 0.2 μm or more, further preferably 0.5 μm or more, and most preferably 1.0 μm. The thickness of the support is preferably 100 to 160 μm and preferably 120 to 150 μm for the use as a post card. In addition, in order to regulate spectral reflective density balance on the white background after being processed and to improve white background, it is preferable to add minute amount of blue-tinting agent or red-tinting agent such as ultramarine blue or an oil-soluble dye in a white pigment containing water-proof resin in the reflective support or in a hydrophilic colloidal layer coated.

The support may be subjected to corona discharge, UV ray irradiation and flame processing as necessary. One or two or more subbing layers may be provided thereon for improving properties such as adhesiveness of a support surface, anti-static property, dimension stability, anti-friction property, hardness, anti-halation property, friction properties and/or other properties.

The silver halide emulsion may have arbitrary halogen composition such as silver chloride, silver bromoiodide, silver bromochloroiodide and silver iodochloride. Substantially, silver bromochloride not containing silver iodide is preferable. In terms of rapid processability, the silver halide emulsion containing silver chloride of preferably 97 mol % or more and more preferably 98–100 mol % or more.

In order to obtain the silver halide emulsion used for the present invention, a silver halide emulsion having a portion where silver bromide is contained in high density. In this occasion, the portion where silver bromide is contained in high density may be epitaxy joint with silver halide grains or may form a so-called core/shell structure. In addition, it does not form a complete layer in which regions where composition is different partially may exist. Incidentally, composition may vary continuously or uncontinuously. It is specifically preferable that the portion where silver bromide is contained in high density is the vertex of crystal grains on the surface of silver halide grains.

In order to obtain the silver halide emulsion, it is advantageous to incorporate bimetal ion. As a bimetal ion capable of being used for aforesaid purpose, metals participating in 8th through 10th periodic law such as iron, iridium, platinum, palladium, nickel, rhodium, osmium, ruthenium and cobalt, transition metals participating in 12th periodic law such as cadmium, zinc and mercury and each ion of lead, rhenium, molybdenum, gallium and chrome. Of these, metallic ions such as iron, iridium, platinum, ruthenium, gallium and osmium are preferable.

Aforesaid metallic ions may be added to the silver halide emulsion in forms of salt and complex salt.

When the above-mentioned bimetallic ions form a complex salt, as its ligand or ion, cyanide ion, thiocyanate ion, cyanate ion, chloride ion, bromide ion, iodide ion, nitrate ion, carbonyl and ammonia are cited. Of these, a cyanide ion, thiocyante ion, cyanate ion, chloride ion and bromide ion are preferable.

In order to incorporate a bimetallic ion in the silver halide emulsion, aforesaid bimetallic compound may add at an arbitrarily step including prior to forming the silver halide grains, during forming the silver halide grains and during physical ripening processing after forming the silver halide grains. In order to obtain the silver halide emulsion satisfying aforesaid conditions, a bimetallic compound may be dissolved together with a halogenated salt and may be added continuously whole through entire grain formation process or at a part thereof.

The amount of the above-mentioned bimetallic ion when being added to the silver halide emulsion is preferably $1\times10^{-9}$ mol or more and $1\times10^{-2}$ mol or less, and specifically preferably $1\times10^{-8}$ mol or more and $5\times10^{-5}$ mol or less.

The preparation of the silver halide grains used for the present invention may be arbitrary. In addition, by the use of methods described in references such as U.S. Pat. Nos. 4,183,756 and 4,225,666 and Japanese Patent O.P.I. Publication No. 26589/1980, Japanese Patent Publication No. 42737/1980 and The Journal of Photographic Science (J. Photogr. Sci) Nos. 21 and 39 (1973), grains having forms of octahedral, tetradecahedral and dodecahedral are formed to be used. In addition, grains having twinned plane may be used.

The silver halide grains used for the present invention may be grains of a single form. Specifically, it is preferable to add two or more kind of mono-dispersed silver halide emulsion to an identical layer.

There is no limit to grain size of the silver halide grains used for the present invention. However, if considering other photographic performances such as rapid processability and speed, 0.1–1.2 $\mu$m is preferable, and 0.2–1.0 $\mu$m is more preferable.

Aforesaid grain size can be measured using projected area or diameter approximate value of the grains. If the grains are substantially uniform, the grain size distribution can be represented considerably accurately in terms of diameter or projected area.

The silver halide grains used for the present invention is a mono-dispersed silver halide grains in which variation coefficient of 0.22 or less and preferably 0.15 or less. It is specifically preferable to add two or more kind of mono-dispersed emulsion whose variation coefficient is 0.15 or less to an identical layer. Here, variation coefficient is a coefficient representing the width of grain size distribution, and defined by the following equation:

$$\text{Variation coefficient}=S/R$$

wherein S represents a standard deviation of grain size distribution; and R represents an average grain size.

Here, "grain size" means a diameter of the silver halide grains when it is spherical. When the form of grain cubic or other than spherical, it means a diameter of a projected inage when it is converted to a circle.

As a preparation device and method of the silver halide emulsion, various conventional ones known by those skilled in the art can be used.

The silver halide emulsion used for the present invention may be obtained any of an acid method, a neutral method and an ammonia method. Aforesaid grains may be grown at one step. They may be grown after forming seed grains. How to produce seed grains and how to grow grains may be the same or different.

As a method of reacting a soluble silver salt and a soluble halogenated substance salt, any methods including a normal precipitation method, a reverse precipitation method, a double jet method and their mixture may be used. It is preferable to use the double jet method. In addition, as one type of the double jet method, a pAg controlled double jet method described in Japanese Patent O.P.I. Publication No. 48521/1979 may be used.

With regard to reacting device, a device disclosed in Japanese Patent O.P.I. Publication Nos. 92523/1982 and 92524/1982 wherein a water-soluble silver salt and an aqueous water-soluble halogenated substance salt solution are fed from an addition sub-device which is located in a reacting initial solution, a device disclosed in German Open Patent No. 2921164 wherein the density of a water-soluble silver salt and an aqueous water-soluble halogenated substance salt solution are continuously changed to be added and a device disclosed in Japanese Patent Publication No. 501776/1981 wherein a reacting initial solution is taken up to outside of the reacting vessel and grains are formed while keeping distance between each silver halide grain by condensing grains by means of an ultrafiltration method may be used.

If necessary, a silver halide solvent such as thioether may be used. A compound having a mercapto group or a compound such as a nitrogen-containing compound or a sensitizing dye may be added during forming silver halide grains or after finish of forming the grains.

The silver halide emulsion may be subjected to a sensitization method using a gold compound and a sensitization method using a charcogen sensitizer in combination.

As a charcogen sensitizer applicable to the silver halide emulsion of the present invention, a sulfur sensitizer, a selenium sensitizer and a tellurium sensitizer may be used. Of these, a sulfur sensitizer is preferable. As a sulfur sensitizer, a thiosulfate, an arylthiocarbamide thiourea, an arylisothiacyanate, cystine, p-toluenethiosulfonic acid salt, rhodanine and inorganic sulfur are cited.

The added amount of the sulfur sensitizer of the present invention may be changed depending upon the kind of silver halide emulsion applied and the scale of expected effects. It is preferably $5\times10^{-10}$–$5\times10^{-5}$ mol and more preferably $5\times10^{-8}$–$3\times10^{-5}$ mol per mol of silver halide.

A gold sensitizer of the present invention may be added as each gold complex such as chloro aurate and gold sulfide. As a ligand compound used, dimethyl rhodanine, thiocyanate, mercapto tetrazole and mercapto triazole may be cited. The added amount of gold compound is not uniform depending upon the kind of the silver halide emulsion, the kind of compound used and ripening conditions. It is preferably $1\times10^{-4}$–$1\times10^{-8}$ mol and more preferably $1\times10^{-5}$–$1\times10^{-8}$ mol per mol of silver halide.

As a chemical sensitization method of the silver halide emulsion of the present invention, a reduction sensitization method may be used.

To the silver halide emulsion, in order to prevent fogging which occurs during preparation process of the silver halide photographic light-sensitive material, to minimize performance fluctuation during storage and to prevent fogging which occurs when a light-sensitive material is developed, a conventional anti-foggant and a stabilizer. As an example of a preferable compound usable for aforesaid purposes, compounds represented by Formula (II) described in Japanese Patent O.P.I. Publication No. 146036/1990, on page 7, at the lower column can be cited. As more preferable compounds, compounds (IIa-1) through (IIa-8) and (IIb-1) through (IIb-7) described in aforesaid invention, on page 8 and compounds such as 1-(3-methoxyphenyl)-5-mercaptotetrazole and 1-(4-ethoxyphenyl)-5-mercapto tetrazole are cited.

Depending on their purposes, the above-mentioned compounds may be added in a preparation process, a chemical sensitization process, after aforesaid chemical sensitization process and a coating solution preparation process. When chemical sensitization is conducted in the presence of aforesaid compounds, the amount used is preferably $1\times10^{-5}$–$5\times10^{-4}$ mol per mol of silver halide. When adding them after finish of the chemical sensitization, the amount added is preferably $1\times10^{-6}$–$1\times10^{-2}$ mol and more preferably $1\times10^{-5}$–$5\times10^{-3}$ mol per mol of silver halide. When adding there to the silver halide emulsion layer in the coating solution preparation process, the amount added is preferably $1\times10^{-6}$–$1\times10^{-1}$ mol and more preferably $1\times10^{-5}$–$1\times10^{-2}$ mol per mol of silver halide. When they are added to layers other than the silver halide emulsion layer, the amount of them in the coating layer is preferably $1\times10^{-9}$–$1\times10^{-3}$ mol per 1 $m^2$.

To the silver halide photographic light-sensitive material used for the present invention, a dye which has absorption on various wavelength region for the purposes of anti-irradiation and anti-halation. For aforesaid purposes, any of various compounds can be used. As a dye having absorption on a visible region, dyes of Formula III described in Japanese Patent O.P.I. Publication No. 281649/1993, dyes AI-1 through 11 described in Japanese Patent O.P.I. Publication 251840/1991, on page 308 and dyes described in Japanese Patent O.P.I. Publication No. 3770/1994 are preferably used. As an infrared absorption dye, compounds represented by Formulas (I), (II) and (III) described in Japanese Patent O.P.I. Publication No. 280750/1989, on page 2, at lower left column have preferable spectral properties. They provide no adverse influence on the photographic properties of the silver halide photographic emulsion and also provide no contamination due to color residue. As practical examples preferred, illustrated compounds (1) through (45) illustrate in aforesaid specification, from page 3, lower left column to 5 page lower left column. With regard to an amount in which aforesaid dyes are added, if the purpose of to improve sharpness, an amount which causes the spectral reflective density of unprocessed sample at 680 nm is 0.7 or more is preferable, and 0.8 or more is specifically preferable.

It is preferable to add a fluorescent brightening agent in the light-sensitive material, since its white background can be improved. As a compound preferably used, compounds represented by Formula II in Japanese Patent O.P.I. Publication No. 232652/1990 are cited.

When a silver halide photographic light-sensitive material is used as a color photographic light-sensitive material, it is combined with a yellow coupler, a magenta coupler and a cyan coupler to have layers containing a silver halide emulsion subjected to spectral sensitization on a specific region of 400–900 nm. Aforesaid silver halide emulsion contains one kind of or two or more kind of sensitizing dyes in combination.

As a spectral sensitizing dye used in the silver halide emulsion, any of conventional compounds can be used. As a blue sensitive sensitizing dye, compounds represented by Formulas I and II described in Japanese Patent O.P.I. Publication No. 158358/1992 and BS-1 through 8 described in Japanese Patent O.P.I. Publication No. 251840/1991 can be preferably used independently or mixingly in combination. As a green sensitive sensitizing dye, GS-1 through 5 described in Japanese Patent O.P.I. Publication No. 251840/1991, on page 28 are preferably used. As a red sensitive sensitizing dye, compounds represented by Formula IIa described in Japanese Patent O.P.I. Publication No. 216342/1989 and RS-1 through 8 described in Japanese Patent O.P.I. Publication No. 251840/1991 are preferably used. When an image is exposed to infrared beam using a semi-conductor laser, it is necessary to use an infrared sensitive sensitizing dye. As an infrared sensitive sensitizing dye, dyes IRS-1 through 11 described in Japanese Patent O.P.I. Publication No. 285950/1992 are preferably used. It is preferable to mix aforesaid infrared, red, green and blue sensitive sensitizing dyes with super sensitizers SS-1 through SS-9 described in Japanese Patent O.P.I. Publication No. 285950/1992, on pp. 8–9 or compounds S-1 through S-17 described in Japanese Patent O.P.I. Publication No. 66515/1993, on pp. 15–17. In addition, compounds represented by Formulas IV and V described in Japanese Patent O.P.I. Publication No. 216342/1989 are preferable.

Addition timing of aforesaid sensitizing dye may be arbitrary from formation of the silver halide grains to finish of chemical sensitization.

As an addition method of the sensitizing dye, they may be dissolved in water-mixing organic solvent such as methanol, ethanol, alcohol fluoride, acetone and dimethylformamide or water, and added as a solution. Or, they may be added as a solid dispersant.

As a coupler other than the yellow coupler used for the silver halide photographic light-sensitive material of the present invention, those known as a magenta dye forming coupler having a spectral absorption maximum wavelength on wavelength range of 500–600 nm and those known as a cyan dye forming coupler having a spectral absorption maximum wavelength on wavelength region of 600–750 nm.

As a cyan coupler preferably used for the silver halide photographic light-sensitive material of the present invention, couplers represented by Formulas (C-I) and (C-II) described in Japanese Patent O.P.I. Publication No. 114154/1992, on page 5 at lower left column. Practical compounds include CC-1 through CC-9 described in aforesaid specification, from page 5 lower right column to page 6 lower left column.

As a magenta coupler preferably used for the silver halide photographic light-sensitive material of the present invention, couplers represented by Formulas (M-I) and (M-II) described in Japanese Patent O.P.I. Publication No. 114154/1992. Practically, those described in aforesaid specification on page 4, lower left column to page 5 upper right column are cited. Of the above-mentioned magenta couplers, the more preferable ones are couplers represented by Formula (M-I) in aforesaid specification, on page 4, upper right column. Further of these, couplers in which $R_M$ of the above-mentioned Formula (M-I) is a tertiary alkyl group is specifically preferable since they are excellent in terms of light fastness. MC-8 through MC-11 described in aforesaid specification, page 5, upper column are excellent in terms of color reproducibility from blue to violet and red, and also excellent in terms of detailed drawing ability.

As a yellow coupler preferably used for the silver halide photographic light-sensitive material of the present invention, couplers represented by Formulas Y-I described in Japanese Patent O.P.I. Publication No. 4-114154/1992. Practically, YC-1 to YC-9 described in aforesaid specification on page 3, lower left column and thereafter are cited. Of the above-mentioned magenta couplers, the more preferable ones are couplers represented by formula Y-1 having alkoxy group as $R_{Y1}$, and couplers represented by formula I of Japanese Patent O.P.I. Publication No. 6-67388 in view of reproduction of preferable yellow tone. Further of these, couplers YC-8 and YC-9 described in Japanese Patent O.P.I. Publication No. 4-114154/1992, page 4, upper left column and Couplers No. 1 to 47 described in Japanese Patent O.P.I. Publication No. 6-67388 are cited as an excellent examples. The most preferable compounds are those represented by formula Y-1 described in pages 1 and 11 to 17 of Japanese Patent O.P.I. Publication No. 4-81847.

In case that the a method of dispersion of oil in water emulsifying process of adding organic compounds such as the coupler, the organic compounds are dissolved in a water insoluble organic solvent having high boiling point, usually not more than 150° C., using, if necessary, low boiling point and/or water soluble organic solvent, and then, dispersed in hydrophilic binder such as gelatin solution with the aid of surfactant. A mixer, a homogenizer, a colloid mill, a flow jet mixer, a ultra sonic dispersion apparatus or so may be used as a dispersion means. A process of removing low boiling point organic solvent may be applied during or after the dispersion process.

The preferable example of the high boiling point organic solvent dissolving the coupler used for the dispersing includes phthalic acid ester compounds such as dioctyl phthalate, di-i-decyl phthalate and dibutyl phthalate, phosphoric acid ester compounds such as tricresyl phosphate or trioctyl phosphate. Dielectric constant of the high boiling point organic solvent is preferably 3.5 to 7.0. Two or more high boiling point organic solvents may be used in combination.

A polymer compound insoluble in water and soluble in organic solvent may be used dispersing the organic compound in place of, or using in combination with the high boiling point organic solvent. The polymer compound is dispersed with the organic compound in hydrophlic binder such as gelatin solution with the aid of surfactant. An example of the polymer includes poly(N-t-butylacrylamide).

As a preferable surfactant used for regulating surface tension when photographic additives are dispersed or coated, hydrophobic group having 8 to 30 carbons in one molecule and a sulfonic acid group and their salt. Practically, A-1–A-11 described in Japanese Patent O.P.I. Publication No. 26854/1989 are cited. In addition, surfactants in which a fluorine atom is substituted with an alkyl group are also preferably used. Aforesaid dispersed solution are ordinarily added to a coating solution containing a silver halide emulsion. Time until they are added to the coating solution after being dispersed and time from they are added to the coating solution to coating are the shorter the better. They are respectively within 10 hours. Within 3 hours and within 20 minutes are more preferable.

It is preferable to use an anti-color fading agent in combination with each of the above-mentioned couplers in order to prevent color fading of dye image due to light, heat and humidity. As a preferable compound for a magenta dye use, phenyl-ether-containing compounds represented by Formulas I and II described in Japanese Patent O.P.I. Publication No. 66541/1990, on page 3, phenol-containing compounds represented by Formula IIIB described in Japanese Patent O.P.I. Publication No. 174150/1991, amine-containing compounds represented by Formula A in Japanese Patent O.P.I. Publication No. 90445/1989 and metallic complex represented by Formula XII, XIII, XIV and XV described in Japanese Patent O.P.I. Publication 182741 are preferable. As preferable compounds for a yellow dye and a cyan dye, compounds represented by I' described in Japanese Patent O.P.I. Publication No. 196049/1989, compounds represented by Formula II described in Japanese Patent O.P.I. Publication No. 11417/1993 and compounds represented by Formula I described in Japanese Patent O.P.I. Publication No. 266077/1994 are preferable.

In order to shift absorption wavelength of a coloring dye, a compound (d-11) described in Japanese Patent O.P.I. Publication No. 114154/1992, page 9, on lower left column and compound (A'-1) described in aforesaid specification, on page 10, on a lower left column can be used. Other than above, fluorescent dye releasing compounds described in U.S. Pat. No. 4,774,187 can be used.

With regard to the silver halide light-sensitive material, it is preferable to minimize color stain by adding a compound which reacts with a developing agent oxidized product and adding between a light-sensitive layer and another light-sensitive layer. As a compound used for aforesaid purpose, hydroquinone derivatives are preferable. More preferably, dialkyl hydroquinone such as 2,5-di-t-octyl hydroquinone is preferable. More specifically, compounds represented by Formula II described in Japanese Patent O.P.I. Publication No. 133056/1992 are cited, and compounds II-1 through II-14 described in aforesaid specification, pp. 13–14 and compound 1 described on page 17 are cited.

It is also preferable to add a UV absorber to the light-sensitive material of the present invention, in order to minimize static fogging and improve light-fastness of a dye image. Preferable UV ray absorbers include benzotriazoles. The specifically preferable compounds include compounds represented by Formula III-3 in Japanese Patent O.P.I. Publication No. 250944/1989, compounds represented by Formula III described in Japanese Patent O.P.I. Publication No. 66646/1989, UV-1L–UV-27L described in Japanese Patent O.P.I. Publication No. 187240/1988, compounds represented by Formula I described in Japanese Patent O.P.I. Publication No. 1633/1992 and compounds represented by Formulas (I) and (II) described in Japanese Patent O.P.I. Publication No. 165144/1993 are cited.

It is advantageous to use gelatin as a binder in the silver halide photographic light-sensitive material. As necessary, other gelatins, gelatin derivatives, graft polymer between gelatin and another polymer, protein other than gelatin, sugar derivatives, cellulose derivatives and hydrophilic colloid such as synthetic hydrophilic polymer such as a monomer or a copolymer may be used.

In order to prevent propagation of mildews and bacteria which adversely influence photographic performance and image storage stability, it is preferable to incorporate anti-mildew agent and an antiseptics as described in Japanese Patent O.P.I. Publication No. 157646/1992.

When coating a photographic light-sensitive material employing a silver halide emulsion, a thickening agent may be used for improving coating properties. As a coating method, an extrusion coating method and a curtain coating method are specifically useful which can coat two or more kind of layers concurrently.

In order to form a photographic image using the silver halide photographic light-sensitive material, an image recorded on the negative film may be optically image-formed on the silver halide photographic light-sensitive material to be printed. Aforesaid image may be temporarily converted to digital information and the resulting image may be;image-formed on a CRT (cathode ray tube), and then, aforesaid image may be image-formed on the silver halide photographic light-sensitive material to be printed. Or, an image may be printed by scanning while the strength of the laser beam is changed The light-sensitive material does not preferably contain a developing agent in the light-sensitive material is applied to a light-sensitive material forming an image for direct appreciation specifically. For example, it is applicable to color paper, color reversal paper, light-sensitive materials forming a positive image, light-sensitive materials for display use and light-sensitive materials for color proof use. Specifically, it is preferable to apply to light-sensitive materials having a reflective support.

As an aromatic primary amine developing agent, conventional compounds may be used. As examples of aforesaid compounds, the following compounds may be illustrated:

CD-1) N,N-diethyl-p-phenylenediamine

CD-2) 2-amino-5-diethylamino toluene

CD-3) 2-amino-5-(N-ethyl-N-)laurylamino)toluene

CD-4) 4-(N-ethyl-N-(b-hydroxyethyl)amino)aniline

CD-5) 2-methyl-4-(N-ethyl-N-(b-hydroxyethyl)amino) aniline

CD-6) 4-amino-3-methyl-N-ethyl-N-(b-(methansulfonamide)ethyl)aniline

CD-7) N-(2-amino-5-diethylaminophenylethyl) methanesulfonamide

CD-8) N,N-dimethyl-p-phenylenediamine

CD-9) 4-amino-3-methyl-N-ethyl-N-methoxyethylaniline

CD-10) 4-amino-3-methyl-N-ethyl-N-(b-ethoxyethyl) aniline

CD-11) 4-amino-3-methyl-N-ethyl-N-(g-hydroxypropyl) aniline

The above-mentioned color developing solution may be used at an arbitrary pH region. However, from viewpoint of rapid processability, it is preferable that pH is 9.5 to 13.0, and it is more preferable that pH is 9.8 to 12.0.

The processing temperature of color developing of the present invention is 35° C. or more and 70° C. or less. The higher the temperature is, the shorter the processing time is. However, if the temperature is not too high, stability of the processing solution is acceptable. It is preferable to process at 37° C. or higher and 60° C. or lower.

Color developing time is conventionally 3 minutes and 30 seconds. Less than 40 seconds is preferable, and within 25 seconds is more preferable.

To a color developing solution, conventional developing solution component compounds may be added in addition to the above-mentioned color developing agent. Ordinarily, development inhibitors such as an alkaline agent having pH buffer effect, chlorine ion and benzotriazole, preserver and a chelating agent are used.

The silver halide photographic light-sensitive material of the present invention may be subjected to bleaching process and fixing process after color developing. The bleaching process may be conducted concurrently with the fixing process. After fixing process, it is ordinary that washing process is applied. In place of the washing process, stabilizing process may be applied. As a developing apparatus used for developing the silver halide photographic light-sensitive material of the present invention, a roller transportation type in which a light-sensitive material is sandwiched by rollers provided in the processing tank to be conveyed or an endless belt type in which the light-sensitive material is fixed on a belt. In addition, a system in which the processing tank is formed in a slip shaped and the light-sensitive material is conveyed together with feeding the processing solution onto aforesaid processing tank, a spray type in which a processing solution is sprayed, a web type in which a carrier immersed in the processing solution is contacted and a type using a viscosity processing solution. When a light-sensitive material is processed in a large amount, it is ordinary to conduct running processing using an automatic developing machine. In this occasion, the replenishment amount of the replenisher solution is smaller, the preferable. The most preferable processing style from viewpoint of environment friendliness is to add a replenishing solution in a form of replenishing tablet. A method disclosed in Published Technical Report No. 16935/1994 is the most preferable.

EXAMPLE

The present invention will be explained referring to examples.

Example 1

On both sides of paper pulp whose weight was 180 g/m$^2$, high density polyethylene was laminated so that a paper support was prepared. On a side in which an emulsion layer was coated, molten polyethylene containing anatase type titanium oxide in which its surface has been processed was dispersed in the content of 15 wt % so that a reflective support was prepared. The center plane average roughness (SRa) is 0.12 $\mu$m. This reflective support was subjected to corona discharge, and then a gelatin subbing layer was prepared. The coating solution was prepared in the following manner.

Coating solution for the first layer

To 23.4 g of a yellow coupler (Y-1), 3.34 g of dye image stabilizer (ST-1), 3.34 g of (ST-2), 3.34 g of (ST-5), 0.34 g of anti-stain agent (HQ-1), 5.0 g of image stabilizer A, 3.33 g of a high boiling organic solvent (DBP) and 1.67 go of a high boiling organic solvent (DNP), 60 ml of ethyl acetic acid was added to be dissolved. Using a ultrasonic homogenizer, the above-mentioned solution was emulsified and dispersed in a 10% aqueous gelatin solution containing 7 ml of a 20% surfactant (SU-1) so that a yellow coupler dispersed solution was prepared. This dispersed solution was mixed with a blue sensitive silver halide emulsion prepared under the following conditions so that a coating solution for the first layer was prepared.

The coating solutions for the second layer through 7th layer were also prepared in the same manner as in the coating solution for the first layer having an amount as shown in Tables 1 and 2.

As a coating aid, surfactants (SU-2) and (SU-3) were added for regulating surface tension. In each layer, F-1 was added in a manner that the total amount thereof would be 0.04 g/m$^2$.

TABLE 1

| Layer | Composition | Amount (g/m$^2$) |
|---|---|---|
| 7th layer (Protective layer) | Gelatin | 0.80 |
| | DIDP | 0.002 |
| | DBP | 0.002 |
| | Hardener (HC-1) | 0.05 |
| 6th layer (UV ray absorption layer) | Gelatin | 0.40 |
| | AI-1 | 0.01 |
| | UV absorber (UV-1) | 0.12 |
| | UV absorber (UV-2) | 0.04 |
| | UV absorber (UV-3) | 0.16 |
| | Anti-stain agent (HQ-5) | 0.04 |
| | PVP | 0.03 |
| 5th layer (Red sensitive layer) | Gelatin | 1.30 |
| | Red sensitive silver bromochloride emulsion (Em-R) | 0.21 |
| | Cyan coupler (C-1) | 0.25 |
| | Cyan coupler (C-2) | 0.08 |
| | Dye image stabilizer (ST-1) | 0.10 |
| | Anti-stain agent (HQ-4) | 0.004 |
| | DBP | 0.10 |
| | DOP | 0.20 |
| 4th layer (UV ray absorption layer) | Gelatin | 0.90 |
| | UV absorber (UV-1) | 0.28 |
| | UV absorber (UV-2) | 0.09 |
| | UV absorber (UV-3) | 0.38 |
| | AI-1 | 0.02 |
| | Anti-stain agent (HQ-5) | 0.10 |
| | Hardener (HC-1) | 0.25 |

TABLE 2

| Layer | Composition | Amount (g/m$^2$) |
|---|---|---|
| 3rd layer (Green sensitive layer) | Gelatin | 1.30 |
| | AI-2 | 0.01 |
| | Green sensitive silver bromochloride emulsion (Em-G) | 0.14 |

TABLE 2-continued

| Layer | Composition | Amount (g/m$^2$) |
|---|---|---|
| | Magenta coupler (M-1) | 0.20 |
| | Dye image stabilizer (ST-3) | 0.20 |
| | Dye image stabilizer (ST-4) | 0.17 |
| | DIDP | 0.13 |
| | DBP | 0.13 |
| 2nd layer (Intermediate layer) | Gelatin | 1.20 |
| | AI-3 | 0.01 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.04 |
| | DBP | 0.02 |
| | Fluorescent brightening agent (W-1) | 0.10 |
| | Hardener (HC-1) | 0.025 |
| 1st layer (Blue sensitive layer) | Gelatin | 1.20 |
| | Blue sensitive silver bromochloride emulsion (Em-B) | 0.26 |
| | Yellow coupler (Y-1) | 0.70 |
| | Dye image stabilizer (ST-1) | 0.10 |
| | Dye image stabilizer (ST-2) | 0.10 |
| | Anti-stain agent (HQ-1) | 0.01 |
| | Image stabilizer A | 0.15 |
| | DNP | 0.05 |
| | DBP | 0.10 |

TABLE 2-continued

| Layer | Composition | Amount (g/m$^2$) |
|---|---|---|
| Support | Polyethylene laminated paper (containing fine amount of coloring agent) | |

Amount of silver halide emulsion was represented in conversion to silver.

SU-1: Sodium tri-i-propyl naphthalene sulfonic acid
SU-2: Sodium salt of sulfosuccinic acid di(2-ethylhexyl
SU-3: Sodium salt of sulfosuccinic acid di(2,2,3,3,4,4,5,5,-octafluoropentyl
DBP: Dibutylphthalate
DNP: Dinonylphthalate
DOP: Dioctylphthalate
DIDP: Di-i-decylphthalate
PVP: Polyvinylpyrrolidone
HQ-1: 2,5-di-t-octyl hydroquinone
HQ-2: 2,5-di-sec-dodecyl hydroquinone
HQ-3: 2,5-di-sec-tetradecyl hydroquinone
HQ-4: 2-sec-dodecyl-5-sec-tetradecyl hydroquinone
HQ-5: 2,5-di(1,1-dimethyl-4-hexyloxycarbonyl)butyl hydroquinone
Image stabilizer A: p-t-octylphenol

Y-1

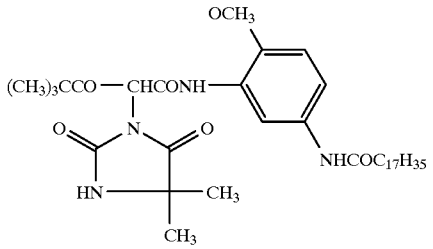

M-1

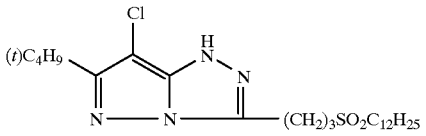

C-1

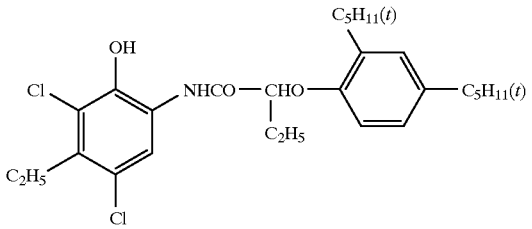

C-2

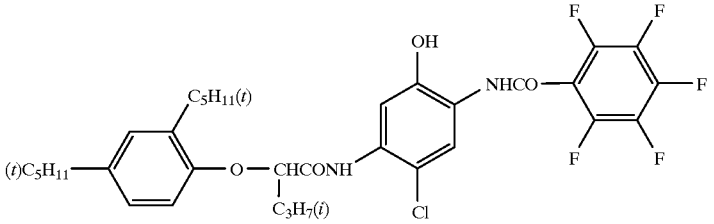

-continued
ST-1
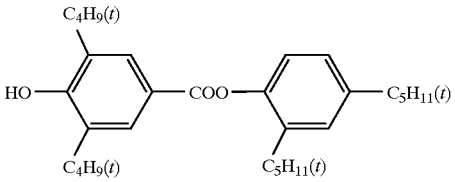
ST-2
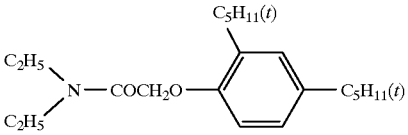
ST-3
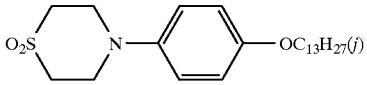
ST-4
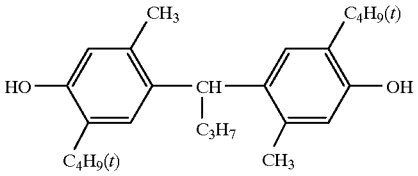
ST-5
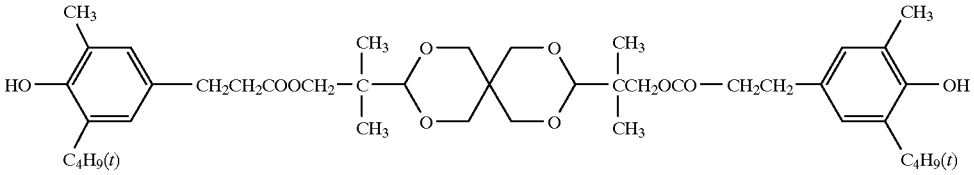
UV-1
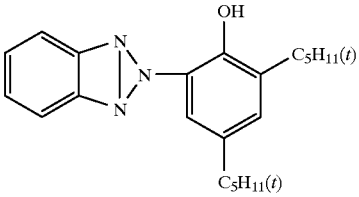
UV-2
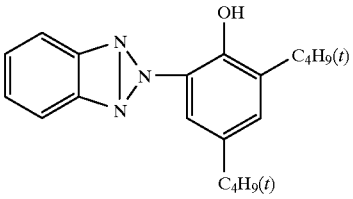
UV-3
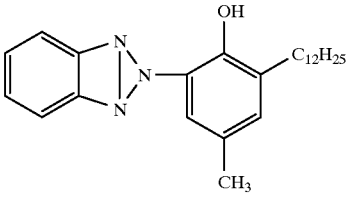

-continued

AI-1

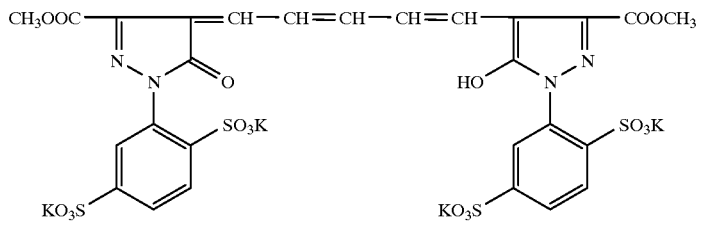

AI-2

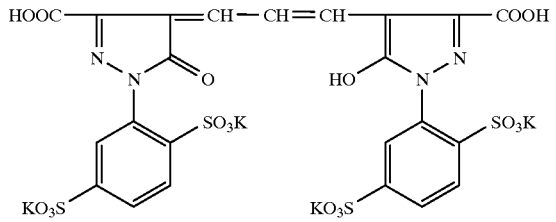

AI-3

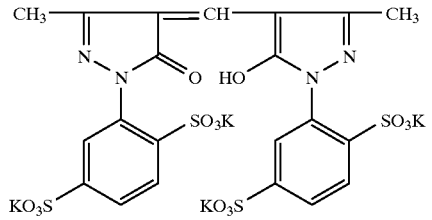

W-1

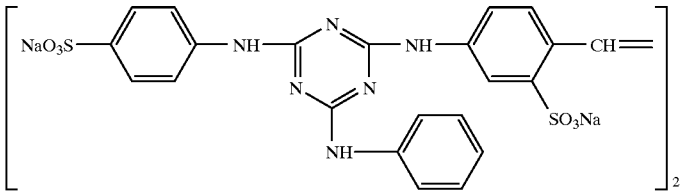

F-1

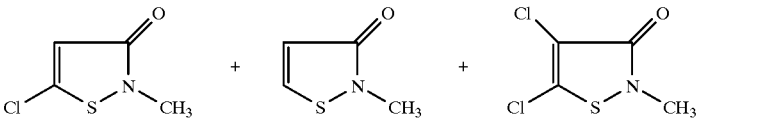

(50%) (46%) (4%) mole ratio mixture at mole ratio of 50:46:4

HC-1

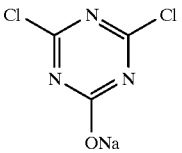

(Preparation of blue sensitive silver halide emulsion)

In 1 liter of an aqueous 2% gelatin solution kept at 40° C., the following solutions A and B were simultaneously added spending 30 minutes while pAg was regulated to 7.3 and pH was regulated to 3.0. In addition, the following solutions C and D were simultaneously added spending 180 minutes while pAg was regulated to 8.0 and pH was regulated to 5.0. In this occasion, pAg was regulated by a method described in Japanese Patent O.P.I. Publication No. 45437/1984, and pH was regulated using sulfuric acid or an aqueous sodium hydroxide solution.

(Solution A)

| | |
|---|---|
| Sodium chloride | 3.42 g |
| Potassium bromide | 0.03 g |
| Water was added to make 200 ml. | |

(Solution B)

| | |
|---|---|
| Silver nitrate | 10 g |
| Water was added to make 200 ml. | |

(Solution C)

| | | |
|---|---|---|
| Sodium chloride | 102.7 | g |
| $K_2IrCl_6$ | $4 \times 10^{-8}$ | mol/mol Ag |
| $K_4Fe(CN)_6$ | $2 \times 10^{-5}$ | mol/mol Ag |
| Potassium bromide | 1.0 | g |
| Water was added to make 600 ml. | | |

(Solution D)

| | |
|---|---|
| Silver nitrate | 300 g |
| Water was added to make 600 ml. | |

After finish of addition, the resulting solution was subjected to desalting using an aqueous 5% Demol N produced by Kao Atlas and an aqueous 20% magnesium sulfate solution. Following this, the resulting solution was mixed with an aqueous gelatin solution so that a mono-dispersed cubic emulsion EMP-1 wherein the average grain size was 0.71 $\mu$m, the variation coefficient of grain distribution was 0.07 and silver chloride content was 99.5 mol % was obtained. Next, a mono-dispersed cubic emulsion EMP-1B was obtained wherein the average grain size was 0.64 $\mu$m, the variation coefficient of grain size distribution was 0.07 and silver chloride content was 99.5 mol % was obtained in the same manner as in EMP-1 except the addition time of Solutions A and B and that of Solutions C and D were changed.

The above-mentioned EMP-1 was subjected to the most suitable chemical sensitization at 60° C. using the following compound. EMP-1B was also subjected to the most suitable chemical sensitization at 60° C. Following this, the sensitized EMP-1 and EMP-1B was mixed at a ratio of 1:1 to obtain a blue sensitive silver halide emulsion (Em-B) was obtained.

| | | |
|---|---|---|
| Sodium thiosulfate | 0.8 | mg/mol of Silver halide |
| Chloro aurate | 0.5 | mg/mol of Silver halide |
| Stabilizer STAB-1 | $3 \times 10^{-4}$ | mol/mol of Silver halide |
| Stabilizer STAB-2 | $3 \times 10^{-4}$ | mol/mol of Silver halide |
| Stabilizer STAB-3 | $3 \times 10^{-4}$ | mol/mol of Silver halide |
| Sensitizing dye BS-1 | $4 \times 10^{-4}$ | mol/mol of Silver halide |
| Sensitizing dye BS-2 | $1 \times 10^{-4}$ | mol/mol of Silver halide |

(Preparation of green sensitive silver halide emulsion)

Next, a mono-dispersed cubic emulsion EMP-2 was obtained wherein the average grain size was 0.40 $\mu$m, the variation coefficient of grain size distribution was 0.08 and silver chloride content was 99.5 mol % was obtained in the same manner as in EMP-1 except the addition time of Solutions A and B and that of Solutions C and D were changed.

Next, a mono-dispersed cubic emulsion EMP-2B was obtained wherein the average grain size was 0.50 $\mu$m, the variation coefficient of grain size distribution was 0.08 and silver chloride content was 99.5 mol % was obtained in the same manner as in EMP-1.

The above-mentioned EMP-2 was subjected to the most suitable chemical sensitization at 55° C. using the following compound. EMP-2B was also subjected to the most suitable chemical sensitization. Following this, the sensitized EMP-2 and EMP-2B was mixed at a ratio of 1:1 to obtain a green sensitive silver halide emulsion (Em-G) was obtained.

| | | |
|---|---|---|
| Sodium thiosulfate | 1.5 | mg/mol of Silver halide |
| Chloro aurate | 1.0 | mg/mol of Silver halide |
| Stabilizer STAB-1 | $3 \times 10^{-4}$ | mol/mol of Silver halide |
| Stabilizer STAB-2 | $3 \times 10^{-4}$ | mol/mol of Silver halide |
| Stabilizer STAB-3 | $3 \times 10^{-4}$ | mol/mol of Silver halide |
| Sensitizing dye GS-1 | $4 \times 10^{-4}$ | mol/mol of Silver halide |

(Preparation of red sensitive silver halide emulsion)

Next, a mono-dispersed cubic emulsion EMP-3 was obtained wherein the average grain size was 0.40 $\mu$m, the variation coefficient of grain size distribution was 0.08 and silver chloride content was 99.5 mol % was obtained in the same manner as in EMP-1 except the addition time of Solutions A and B and that of Solutions C and D were changed. Next, a mono-dispersed cubic emulsion EMP-2B was obtained wherein the average grain size was 0.38 $\mu$m, the variation coefficient of grain size distribution was 0.08 and silver chloride content was 99.5 mol % was obtained in the same manner as in EMP-3B.

The above-mentioned EMP-3 was subjected to the most suitable chemical sensitization at 60° C. using the following compound. EMP-3B was also subjected to the most suitable chemical sensitization. Following this, the sensitized EMP-3 and EMP-3B was mixed at a ratio of 1:1 to obtain a green sensitive silver halide emulsion (Em-R) was obtained.

| | | |
|---|---|---|
| Sodium thiosulfate | 1.8 | mg/mol of Silver halide |
| Chloro aurate | 2.0 | mg/mol of Silver halide |
| Stabilizer STAB-1 | $3 \times 10^{-4}$ | mol/mol of Silver halide |
| Stabilizer STAB-2 | $3 \times 10^{-4}$ | mol/mol of Silver halide |
| Stabilizer STAB-3 | $3 \times 10^{-4}$ | mol/mol of Silver halide |
| Sensitizing dye RS-1 | $1 \times 10^{-4}$ | mol/mol of Silver halide |
| Sensitizing dye RS-2 | $1 \times 10^{-4}$ | mol/mol of Silver halide |

STAB-1: 1-(3-acetoamidephenyl)-5-mercaptotetrazole

STAB-2: 1-phenyl-5-mercapto tetrazole

STAB-3: 1-(4-ethoxyphenyl)-5-mercapto tetrazole

In addition, SS-1 was added to the red sensitive emulsion by $2.0 \times 10^{-3}$ per mol of silver halide.

BS-1

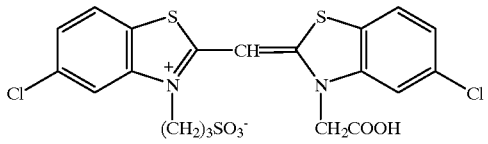

-continued

BS-2

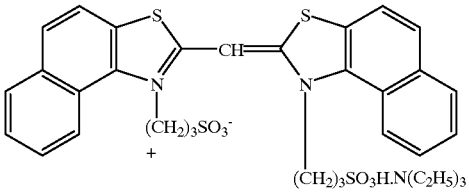

GS-1

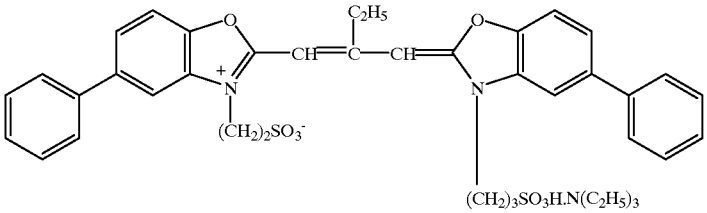

RS-1

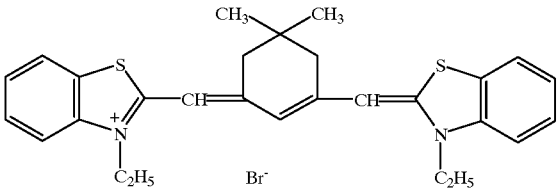

RS-2

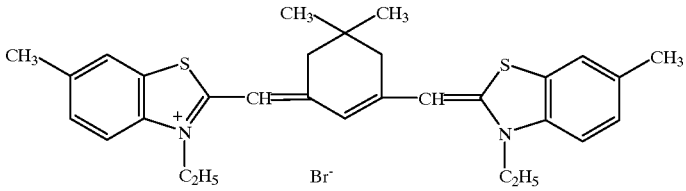

SS-1

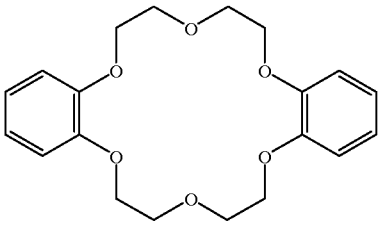

A sample prepared in the above-mentioned manner was defined to be Sample 101. Then, Samples 102 was prepared in the same manner as in Sample 101 except that the fine particle powder A shown in Table 3 was added in the 7th layer in an amount of 600 mg/m$^2$. Hundred (100) g of fine particle powder A was mixed into 900 ml of 5% gelatin solution and then dispersed by means of high speed mixer. Water was added to the resulted dispersion to be 1000 ml.

In addition, Samples 103 to 127 were prepared in the same way as Sample 101 except that the fine particle powder A was replaced by those shown in Table 3, in the amount and the adding layer shown in Table 4. Further, the hardener was replaced with those shown in Table 4 in the same mole amount.

TABLE 3

| Fine particle powder | Compound | Average particle size ($\mu$m) | Average pore size | Specific surface area |
|---|---|---|---|---|
| A | Polymethyl-methacrylate | 2.5 | — | — |
| B | Silica | 1.9 | 210 | 300 |
| C | Silica | 2.5 | 170 | 300 |
| D | Siica | 3.5 | 70 | 500 |
| E | Siica | 5.2 | 210 | 300 |
| F | Alumina | 2.4 | 240 | 300 |

The following evaluation was performed for the samples thus prepared.

(Abrasion Resistance Test at Wet Condition)

A black sample prepared by the following photographic processing was cut into a wedge size and immersed in water kept at 35° C. for 1 minute and was then measured immediately using the following method. A continuously weight applying type scratch resistance test machine (Heidon 18 Type manufactured by Shinto Kagaku Co., Ltd.) was employed. According to the specified method, the sample was set and subjected to application of continuous weight of 0 to 50 g. Applied weight when the abrasion is formed on the surface of the sample was measured by the specified method. Evaluation on the abrasion resistance test at the wet condition was performed based on weight obtained. As the figures obtained increases, abrasion resistant property are improved. Further, a sapphire needle of 0.2 mm was employed. For practical application, abrasion resistance of weight 20 g or more is required. The results are shown in Table 4.

(Pressure Resistance Test at Wet Condition)

A sample which had been exposed so as to form the yellow and cyan density of 0.1 to 0.3, respectively upon development was subjected to color development at 35° C. using the color developing solution mentioned hereinafter. During processing, a ball point needle having a diameter of 0.3 mm was moved at a speed of 1 cm/sec on the surface of the sample in the color development solution, while the weight of 0 to 50 g was continuously applied to the ball point needle. The following development process was practiced. When the increase in each density of yellow and cyan due to the pressure, the weight applied to the ball point needle was recorded. The larger the weight, the better pressure resistance properties are obtained. For practical use, the weight of 30 g or more is required. The results are shown in Table 4.

(Evaluation on Writing by Pencil)

An unexposed sample was subjected to development process mentioned in the following and the white sample was prepared. Specified letters and marks were written on the sample surface with a pencil (F) available on the market. The evaluation on the writing was performed according to the following scale. The results are shown in Table 4.

5: Excellent in writing

4: Normal

3: Minimum acceptable level for commercial product

2: Inferior

1: Completely unavailable (Evaluation on Stamping)

An unexposed sample was subjected to the photographic process mentioned hereinafter. A stamp having New Year's greeting words was affixed on the white surface of the processed sample, while using red ink supplied from a red ink pad.

The state of stamped letters was evaluated. In addition, the stamped surface was rubbed three minutes after stamping and the evaluation on the state of rubbed letters was performed according to the following scale. The results are shown in Table 4.

5: Letters are stamped smoothly and are hardly blurred by rubbing.

4: Letters are stamped smoothly and are somewhat blurred by rubbing.

3: Letters are stamped smoothly but the letters are fairly blurred. As a result, it is difficult to identify what letters are stamped. Minimum level to be a commercial product 2: Stamped letters suffer ink repellence. When rubbed, it is difficult to identify what is stamped.

1: Stamped letters suffer remarkably ink repellence. When rubbed, letters are mostly blurred and it is impossible to identify what is stamped.

Developing steps are listed.

| Processing Steps | Processing Temperature | Processing Time | Replenishing Amount |
|---|---|---|---|
| Color Developing | 38.0 ± 0.3° C. | 45 sec. | 80 ml |
| Bleach Fixing | 35.0 ± 0.5° C. | 45 sec. | 120 ml |
| Stabilizing | 30–34° C. | 60 sec. | 150 ml |
| Drying | 60–80° C. | 30 sec. | |

Composition of the developing solution will be illustrated as below:

Color developing tank solution and replenishing solution

| | Tank solution | Replenishing solution |
|---|---|---|
| Deionized water | 800 ml | 800 ml |
| Triethylene diamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamide ethyl)-3-methyl-4-aminoaniline sulfate | 6.0 g | 10.0 g |
| N, N-diethyhydroxylamine | 6.8 g | 6.0 g |
| Triethanolamine | 10.0 g | 10.0 g |
| Sodium salt of diethylenetriamine pentaacetic acid | 2.0 g | 2.0 g |
| Fluorescent brightening agent (4,4'-diaminostylbene disulfonic acid derivative) | 2.0 g | 2.5 g |
| Potassium carbonate | 30 g | 30 g |

Water was added to make 1 liter in total. Tank solution was regulated to 10.10, and the replenishing solution was regulated to 10.60.

Bleach fixing solution and its replenishing solution

| | |
|---|---|
| Ferric ammonium dihydride of diethylenetriamine pentaacetic acid | 65 g |
| Diethylenetriamine pentaacetic acid | 3.0 g |
| Ammonium thiosulfate (an aqueous 70% solution) | 100 ml |
| 2-amino-5-mercapto-1,3,4-thiadiazole | 2.0 g |
| Ammonium sulfite (an aqueous 40% solution) | 27.5 ml |

Water was added to make 1 liter in total, and pH was regulated to 5.0 using potassium carbonate or glacial acetic acid.

Stabilizing solution and its replenishing solution

| | |
|---|---|
| o-phenylphenol | 1.0 g |
| 5-chloro-2-methyl-4-isothiazoline-3-on | 0.02 g |
| 2-methyl-4-isothiazoline-3-on | 0.02 g |
| Diethylene glycol | 1.0 g |
| Fluorescent brightening agent (Chinopal SFP) | 2.0 g |
| 1-hydroxyethilidene-1,1-disulfonic acid | 1.8 g |
| Bismuth chloride (an aqueous 45% solution) | 0.65 g |
| Magnesium sulfate.heptahydride | 0.2 g |
| PVP | 1.0 g |
| Aqueous ammonia (an aqueous 25% ammonium hydroxide solution) | 2.5 g |
| Trisodium salt of nitrilo triacetic acid | 1.5 g |

Water was added to make 1 liter in total, and pH was regulated to 7.5 using sulfuric acid or Aqueous ammonia.

TABLE 4

| No. | Fine particle 6th layer | Fine particle 7th layer | Amount (mg/m²) 6th layer | Amount (mg/m²) 7th layer | Hardener | Abrasion Resistance Test g | Pressure Resistance Test (g) Cyan | Pressure Resistance Test (g) Yellow | Writing in Pencil | Writing in Stamping |
|---|---|---|---|---|---|---|---|---|---|---|
| 101 | — | — | — | — | HC-1 | 31 | 36 | 38 | 1 | 1 |
| 102 | — | A | — | 600 | HC-1 | 9 | 17 | 18 | 2 | 1 |
| 103 | — | B | — | 800 | HC-1 | 12 | 14 | 14 | 4 | 3 |
| 104 | — | C | — | 800 | HC-1 | 11 | 12 | 12 | 4 | 4 |
| 105 | — | A | — | 600 | HA-23 | 25 | 36 | 37 | 2 | 1 |
| 106 | — | C | — | 300 | HA-23 | 31 | 36 | 38 | 2 | 2 |
| 107 | — | B | — | 700 | HA-23 | 30 | 37 | 37 | 4 | 4 |
| 108 | — | C | — | 400 | HA-23 | 31 | 37 | 38 | 3 | 3 |
| 109 | — | C | — | 600 | HA-23 | 30 | 36 | 38 | 4 | |
| 110 | — | C | — | 800 | HA-23 | 30 | 36 | 39 | 4 | 4 |
| 111 | — | C | — | 800 | HA-2 | 23 | 32 | 34 | 4 | 4 |
| 112 | — | C | — | 800 | HA-19 | 31 | 32 | 35 | 4 | 4 |
| 113 | — | C | — | 800 | HA-26 | 24 | 33 | 35 | 4 | 4 |
| 114 | — | C | — | 800 | HA-27 | 24 | 33 | 35 | 4 | 4 |
| 115 | — | C | — | 800 | HA-28 | 23 | 33 | 34 | 4 | 4 |
| 116 | — | B | — | 700 | HA-27 | 23 | 33 | 36 | 4 | 4 |
| 117 | — | B | — | 700 | HA-28 | 23 | 34 | 36 | 4 | 4 |
| 118 | — | D | — | 800 | HA-23 | 24 | 34 | 35 | 4 | 4 |
| 119 | — | D | — | 800 | HA-28 | 23 | 33 | 34 | 4 | 4 |
| 120 | — | E | — | 800 | HA-28 | 24 | 33 | 34 | 4 | 4 |
| 121 | — | F | — | 800 | HA-28 | 24 | 33 | 34 | 4 | 4 |
| 122 | — | B | — | 700 | HC-1 (2 and 4th layers) HA-23 (7th layer) | 27 | 33 | 34 | 4 | 4 |
| 123 | — | C | — | 800 | HC-1 (2 and 4th layers) HA-28 (7th layer) | 26 | 34 | 36 | 4 | 4 |
| 124 | B | — | 700 | — | HA-23 | 32 | 38 | 39 | 3 | 3 |
| 125 | C | — | 800 | — | HA-28 | 28 | 33 | 33 | 3 | 3 |
| 126 | D | — | 800 | — | HA-27 | 27 | 34 | 35 | 3 | 3 |
| 127 | B | C | 300 | 400 | HA-23 | 31 | 33 | 35 | 4 | 4 |

The results shown in Table 4 illustrate that Samples 107 to 127 are excellent in tests of Writing by Pencil and Stamping, and further have improved quality of pressure resistance at wet condition and pressure fogging.

Example 2

Dispersion composition of fine particle powder shown in Table 3 were prepared as in Example 1, and they were added as shown in Table 5 as for spices of fine particle powder, content per 1 m², added layer in the same way as Sample 102.

As for a hardening agent, HC-1, which was added to the second and 4th layers, was removed and those shown in Table 5 were added in the 2nd, 4th and 7th layer so that the whole amount was adjusted the amount of HC-1. In this way samples 201 to 212 were prepared.

The same evaluation as Example 1 was conducted for the prepared samples.

TABLE 5

| No. | Fine particle 6th layer | Fine particle 7th layer | Amount (mg/m²) 6th layer | Amount (mg/m²) 7th layer | Hardener | Abrasion Resistance Test g | Pressure Resistance Test (g) Cyan | Pressure Resistance Test (g) Yellow | Writing in Pencil | Writing in Stamping |
|---|---|---|---|---|---|---|---|---|---|---|
| 201 | — | C | — | 350 | HB-1 | 22 | 31 | 31 | 2 | 2 |
| 202 | — | C | — | 800 | HB-1 | 21 | 30 | 31 | 5 | 5 |
| 203 | — | B | — | 800 | HB-8 | 21 | 31 | 32 | 5 | 5 |
| 204 | — | C | — | 800 | HB-8 | 21 | 30 | 30 | 5 | 5 |
| 205 | — | D | — | 800 | HB-8 | 21 | 31 | 31 | 5 | 5 |
| 206 | — | E | — | 800 | HB-8 | 20 | 31 | 32 | 5 | 5 |
| 207 | — | F | — | 800 | HB-8 | 21 | 31 | 32 | 5 | 5 |
| 208 | — | C | — | 800 | HB-11 | 21 | 30 | 31 | 5 | 5 |
| 209 | — | C | — | 800 | HB-14 | 21 | 30 | 32 | 5 | 5 |
| 210 | — | C | — | 800 | HB-31 | 20 | 32 | 32 | 5 | 5 |

TABLE 5-continued

| | Fine particle | | Amount (mg/m²) | | | Abrasion Resistance | Pressure Resistance | | | |
|---|---|---|---|---|---|---|---|---|---|---|
| | 6th | 7th | 6th | 7th | | Test | Test (g) | | Writing in | |
| No. | layer | layer | layer | layer | Hardener | g | Cyan | Yellow | Pencil | Stamping |
| 211 | — | C | — | 800 | HB-62 | 21 | 30 | 32 | 5 | 5 |
| 212 | C | — | 800 | — | HB-8 | 24 | 33 | 34 | 3 | 3 |

The results shown in Table 5 illustrate that Samples 202 to 212 are excellent in tests of Writing by Pencil and Stamping, and further have improved quality of pressure resistance at wet condition and pressure fogging without problem in practical use.

Example 3

Dispersion composition of fine particle powder shown in Table 3 were prepared as in Example 1, and they were added as shown in Table 6 as for spices of fine particle powder, content per 1 m², added layer in the same way as Sample 102. Thus Samples 301 to 311 were prepared.

Amount of polymer hardening agent was adjusted to the same mol by calculating the average molecular weight assuming monomer unit from the ratio of two or more monomers.

The samples were subjected by the same evaluation as Example 1.

TABLE 6

| | Fine particle | | Amount (mg/m²) | | | Abrasion Resistance | Pressure Resistance | | | |
|---|---|---|---|---|---|---|---|---|---|---|
| | 6th | 7th | 6th | 7th | | Test | Test (g) | | Writing in | |
| No. | layer | layer | layer | layer | Hardener | g | Cyan | Yellow | Pencil | Stamping |
| 301 | — | C | — | 350 | HP-1 | 35 | 34 | 36 | 2 | 2 |
| 302 | — | C | — | 800 | HP-1 | 34 | 34 | 36 | 4 | 4 |
| 303 | — | C | — | 800 | HP-2 | 32 | 34 | 36 | 4 | 4 |
| 304 | — | C | — | 800 | HP-6 | 33 | 35 | 37 | 4 | 4 |
| 305 | — | C | — | 800 | HP-11 | 33 | 35 | 36 | 4 | 4 |
| 306 | — | C | — | 800 | HP-15 | 36 | 36 | 37 | 4 | 4 |
| 307 | — | B | — | 800 | HP-1 | 34 | 34 | 36 | 4 | 4 |
| 308 | — | E | — | 800 | HP-15 | 35 | 34 | 36 | 4 | 4 |
| 309 | C | C | 400 | 400 | HP-15 | 36 | 35 | 38 | 4 | 4 |
| 310 | — | C | — | 800 | HC-1 (2nd and 4th layers) HP-1 (7th layer) | 32 | 35 | 36 | 4 | 4 |
| 311 | — | C | — | 800 | HC-1 (2nd and 4th layers) HP-1 (7th layer) | 34 | 36 | 37 | 4 | 4 |

The results shown in Table 6 illustrate that Samples 302 to 311 are excellent in tests of Writing by Pencil and Stamping, and further have improved quality of pressure resistance at wet condition and pressure fogging. Processing condition was changed to the following in Examples 1, 2 and 3.

| Processing Steps | Processing Temperature | Processing Time | Replenishing Amount |
|---|---|---|---|
| Color Developing | 38.0 ± 0.3° C. | 22 sec. | 81 ml |
| Bleach Fixing | 35.0 ± 0.5° C. | 22 sec. | 54 ml |
| Stabilizing | 30–34° C. | 25 sec. | 150 ml |
| Drying | 60–80° C. | 30 sec. | |

Composition of the developing solution will be illustrated as below:

Color developing tank solution and replenishing solution

| | Tank solution | Replenishing solution |
|---|---|---|
| Deionized water | 800 ml | 800 ml |
| Diethylene glycol | 10 g | 10 g |
| Potassium bromide | 0.01 g | — |

-continued

| | Tank solution | Replenishing solution |
|---|---|---|
| Potassium chloride | 3.5 g | — |
| Potassium sulfite | 0.25 g | 0.5 g |
| N-ethyl-N-(β-methanesulfonamide | 6.5 g | 10.5 g |

-continued

| | Tank solution | Replenishing solution |
|---|---|---|
| ethyl)-3-methyl-4-aminoaniline sulfate | | |
| N, N-diethyhydroxylamine | 3.5 g | 6.0 g |
| N,N-bis(2-sulfoethyl)hydroxlamine | 3.5 g | 6.0 g |
| Triethanolamine | 10.0 g | 10.0 g |
| Sodium salt of diethylenetriamine pentaacetic acid | 2.0 g | 2.0 g |
| Fluorescent brightening agent (4,4'-diaminostylbene disulfonic acid derivative) | 2.0 g | 2.5 g |
| Potassium carbonate | 30 g | 30 g |

Water was added to make 1 liter in total. Tank solution was regulated to 10.10, and the replenishing solution was regulated to 10.60.

Bleach fixing solution and its replenishing solution

| | Tank solution | Replenishing solution |
|---|---|---|
| Ferric ammonium dihydride of diethylenetriamine pentaacetic acid | 100 g | 50 g |
| Diethylenetriamine pentaacetic acid | 3 g | 3 g |
| Ammonium thiosulfate (an aqueous 70% solution) | 200 ml | 100 ml |
| 2-amino-5-mercapto-1,3,4-thiadiazole | 2.0 g | 1.0 g |
| Ammonium sulfite (an aqueous 40% solution) | 50 ml | 25 ml |

Water was added to make 1 liter in total, and pH was adjusted to 7.0 for tank solution and 6.5 for replenishing solution using potassium carbonate or glacial acetic acid.

Stabilizing solution and its replenishing solution

| | |
|---|---|
| o-phenylphenol | 1.0 g |
| 5-chloro-2-methyl-4-isothiazoline-3-on | 0.02 g |
| 2-methyl-4-isothiazoline-3-on | 0.02 g |
| Diethylene glycol | 1.0 g |
| Fluorescent brightening agent (Chinopal SFP) | 2.0 g |
| 1-hydroxyethilidene-1,1-disulfonic acid | 1.8 g |
| PVP | 1.0 g |
| Aqueous ammonia (an aqueous 25% ammonium hydroxide solution) | 2.5 g |
| Ethylenediamine tetraacetic acid | 1.0 g |
| Ammonium sulfite (40% aqueous solution) | 10 ml |

Water was added to make 1 liter in total, and pH was regulated to 7.5 using sulfuric acid or Aqueous ammonia.

Evaluation was performed in the same manner as in Example 1 and it was confirmed that the advantages of the present invention were effectively obtained.

Example 5

In Example 4, running processing was performed according to the process termed CPK-2-J1 employing the automatic processor NPS-868J and the processing chemical ECOJET-P manufactured by Konica Corp. Evaluation was performed in the same manner as in Example 1 and it was confirmed that the advantages of the present invention were obtained.

Example 6

With regard to Sample 103 in Example 1, the following measurements were performed using the above-mentioned Cryo SEM method; thickness a of all layers of Sample 103 and thickness a' of the seventh layer comprising porous fine particle powder B after the immersion in distilled water at 25° C. for 3 minutes, and thickness b of all layers and thickness b' of the seventh layer comprising the porous fine particle powder B prior to the immersion in the distilled water. Swell ratio a/b=S of all layers constituting Sample 103 and swell ratio a'/b'=S' of the seventh layer comprising the porous fine particle powder B were then obtained. According to the results obtained, S'/S shown in Table 7 was derived.

Next, Samples 701 to 709 were prepared in the same manner as in Sample 103 except that the hardener HC-1 added to the second, forth and seventh layers was replaced with each of hardeners shown in Table 7 under the same addition amount in terms of mole. Further, the addition amount of the polymeric hardener of the present invention was obtained in the same manner as in Example 3.

The swell ratios of Samples 701 to 709 were measured in the same manner as in Sample 103 and each S'/S was obtained. The results are shown in Table 7.

Next, Samples 701 to 709 were evaluated in the same manner as in Example 1. The results are shown in Table 7.

TABLE 7

| Sample No. | Hardener | Ratio of Swell Ratio S'/S | Weight at Abrasion Resistance Test g | Weight at Pressure Resistance g Cyan | Weight at Pressure Resistance g Yellow | Writing with Pencil Evaluation | Stamping Letters Evaluation |
|---|---|---|---|---|---|---|---|
| 103 | HC-1 | 1.15 | 12 | 14 | 14 | 4 | 3 |
| 701 | Addition of HC-1 to 2nd and 4th layers, and HC-1 and HA-23 to 7th layer in mole ratio of 1:1 | 0.97 | 21 | 31 | 32 | 3 | 3 |
| 702 | Addition of HC-1 to 2nd and 4th layers, and HC-1 and HA-23 to 7th layer in mole ratio of 1:2 | 0.91 | 23 | 32 | 32 | 3 | 3 |
| 703 | Addition of HC-1 to 2nd and 4th layers, and HC-1 and HA-23 to 7th layer in mole ratio of 1:3 | 0.85 | 25 | 35 | 36 | 4 | 4 |
| 704 | HA-23 | 0.78 | 30 | 36 | 38 | 4 | 4 |
| 705 | Addition of HC-1 to 2nd and 4th layers, and HC-1 and HP-15 to 7th | 0.88 | 27 | 34 | 35 | 4 | 4 |

TABLE 7-continued

| Sample No. | Hardener | Ratio of Swell Ratio S'/S | Weight at Abrasion Resistance Test g | Weight at Pressure Resistance g Cyan | Weight at Pressure Resistance g Yellow | Writing with Pencil Evaluation | Stamping Letters Evaluation |
|---|---|---|---|---|---|---|---|
| | layer in mole ratio of 1:1 | | | | | | |
| 706 | HP-15 | 0.72 | 32 | 35 | 37 | 4 | 4 |
| 707 | HA-27 | 0.86 | 24 | 32 | 33 | 4 | 4 |
| 708 | HA-2 | 0.95 | 22 | 32 | 33 | 4 | 4 |
| 709 | HP-1 | 0.74 | 30 | 35 | 36 | 4 | 4 |

Example 7

In Example 6, the same photographic process as Example 4 was performed and the same evaluation as Example 6 was performed. It was confirmed that the advantages of the present invention were obtained.

Example 8

In Example 6, the same photographic process as Example 5 was performed and the same evaluation as Example 6 was performed. It was confirmed that the advantages of the present invention were obtained.

Example 9

According the following method, supports B to F for photographic paper were prepared.

Both of front and back sides of paper pulp having a weight of 180 g/m$^2$ were subjected to corona discharge. On the surface, resin overcoat layer having a thickness of 22 $\mu$m composed of polyethylene comprising 10% anatase type titanium dioxide was formed using an extrusion coating method. Furthermore, on the back side, polyethylene overcoat layer was formed using a co-extrusion coating method. Supports B to F (each thickness=22 $\mu$m) for photographic paper were prepared by applying a cooling roll having an uneven surface to the resulting laminated element. Further, different cooling rollers were employed so that the surface center plane average roughness (SRa) has the value shown in Table 8.

These supports were subjected to corona discharge and a gelatin sublayer was then coated. The same composition as that of the sample in Example 1 was coated on the resulting support and Samples 801 to 805 were prepared. Writing property on the surface was evaluated. The results are shown in Table 8.

TABLE 8

| Sample No. | Support | SRa $\mu$m | Weight at Abrasion Resistance Test g | Weight at Pressure Resistance g Cyan | Weight at Pressure Resistance g Yellow | Writing with Pencil Evaluation | Stamping Letters Evaluation |
|---|---|---|---|---|---|---|---|
| 108 | A | 0.12 | 31 | 37 | 38 | 3 | 3 |
| 801 | B | 0.22 | 32 | 37 | 39 | 4 | 3 |
| 802 | C | 0.55 | 33 | 37 | 39 | 4 | 4 |
| 803 | D | 0.87 | 33 | 38 | 39 | 4 | 4 |
| 804 | E | 1.01 | 34 | 38 | 40 | 5 | 4 |
| 805 | F | 1.23 | 34 | 38 | 40 | 5 | 4 |

Tables 8 clearly shows that in the present invention, the advantages of the present invention are fully obtained utilizing the support having SRa of 0.2 $\mu$m or more.

Example 10

According to the following method, a reflection support G prepared. Both of front and back sides of paper pulp having a weight of 90 g/m$^2$ were subjected to corona discharge. On the surface utilized for emulsion coating, was formed a resin overcoat layer having a thickness of 22 $\mu$m composed of polyethylene comprising 10% anatase type titanium dioxide using an extrusion coating method. Furthermore, on the back side, was formed a polyethylene resin overcoat layer using a co-extrusion coating method. The reflection support G having a surface center plane average roughness (SRa) of 1.05 $\mu$m and a thickness of 140 $\mu$m was prepared by applying a cooling roll having an uneven surface to the resulting laminated element.

Next, reflection supports H to J were prepared in the same manner as in the reflection support G except that the thickness was changed as shown in Table 9, while changing the weight of the paper pulp.

On these supports, was formed the same photographic composition layer as that of sample 103 in Example 1 and Samples 1001 to 1004 were prepared and were subjected to the same evaluation as Example 1.

Next, on these supports, was formed the same photographic composition layer as Sample 109 in Example 1 and samples 1005 to 1008 were prepared and were subjected to the same evaluation as Example 1. The results obtained are shown in Table 9.

TABLE 9

| Sample No. | Support | Thickness $\mu$m | Weight at Abrasion Resistance Test g | Weight at Pressure Resistance g Cyan | Weight at Pressure Resistance g Yellow | Writing with Pencil Evaluation | Stamping Letters Evaluation |
|---|---|---|---|---|---|---|---|
| 103 | A | 230 | 12 | 14 | 14 | 4 | 3 |
| 1001 | G | 140 | 10 | 12 | 11 | 4 | 3 |
| 1002 | H | 158 | 9 | 11 | 10 | 4 | 3 |
| 1003 | I | 122 | 9 | 11 | 10 | 4 | 3 |
| 1004 | J | 108 | 8 | 10 | 9 | 4 | 3 |
| 109 | A | 230 | 30 | 36 | 38 | 4 | 4 |
| 1005 | G | 140 | 30 | 36 | 38 | 5 | 4 |
| 1006 | H | 158 | 30 | 36 | 38 | 5 | 4 |
| 1007 | I | 122 | 30 | 36 | 37 | 5 | 4 |
| 1008 | J | 108 | 29 | 36 | 36 | 5 | 4 |

As seen in Table 9, Samples 1001 to 1004 employing a reflection support having a thickness of 160 $\mu$m or less is subject to deterioration in abrasion and pressure resistance as compared to Sample 103.

On the contrary, it is found that samples 1005 to 1008 employing the reflection support having a thickness of 160 $\mu$m or less are not subject to degradation in abrasion and pressure resistance and are subject to the improvement in writing.

According to the present invention, it is possible to provide a silver halide photographic light-sensitive material which has improved abrasion resistance and pressure resistance in a processing solution, and is excellent in writing and stamping properties.

We claim:

1. A silver halide photographic light-sensitive material comprising at least one light-sensitive silver halide emulsion layer and at least one non-light-sensitive layer on a support wherein the non-light-sensitive layer contains porous fine particles having specific surface area of at least 100 $m^2/g$ and average diameter from 0.1 to 10 $\mu$m in an amount of at least 400 mg per 1 $m^2$, and said material is hardened utilizing at least one of hardener selected from a group consisting of vinyl sulfone hardener, carboxyl-activating hardener and polymeric hardener.

2. The silver halide photographic light-sensitive material according to claim 1, wherein the non-light-sensitive hydrophilic colloid layer which is positioned furthest from the support contains porous fine particles of 400 mg per 1 $m^2$ or more, and the swell ratio of the non-light-sensitive hydrophilic colloid layer comprising the porous fine particles in distilled water is lower than that of all layers constituting said silver halide photographic light-sensitive material in the distilled water.

3. The silver halide photographic light-sensitive material according to claim 2, wherein the porous fine particle is an inorganic compound.

4. The silver halide photographic light-sensitive material according to claim 2, wherein the porous fine particle is silica.

5. The silver halide photographic light-sensitive material according to claim 1, wherein the hardener is vinyl sulfone hardener.

6. The silver halide photographic light-sensitive material according to claim 5, wherein addition amount of the vinyl sulfone hardener is from 1.0 to 1,000 $mg/m^2$ for the silver halide photographic light-sensitive material.

7. The silver halide photographic light-sensitive material according to claim 5, wherein the vinyl sulfone hardener contains three vinyl sulfone groups or more in a molecule.

8. A silver halide photographic light-sensitive material comprising at least one light-sensitive silver halide emulsion layer and at least one non-light-sensitive layer on a support wherein the non-light-sensitive layer contains inorganic porous fine particles having specific surface area of at least 100 $m^2/g$ and an average diameter from 0.1 to 10 $\mu$m in an amount of at least 400 mg per 1 $m^2$and said material is hardened utilizing vinyl sulfone hardener containing three vinyl sulfone groups or more in a molecule.

* * * * *